US010590744B2

(12) United States Patent
Liess

(10) Patent No.: US 10,590,744 B2
(45) Date of Patent: Mar. 17, 2020

(54) MODULAR CONNECTION SYSTEM FOR TOP DRIVE

(71) Applicant: Weatherford Technology Holdings, LLC, Houston, TX (US)

(72) Inventor: Martin Liess, Seelze (DE)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 387 days.

(21) Appl. No.: 15/004,390

(22) Filed: Jan. 22, 2016

(65) Prior Publication Data

US 2017/0074075 A1 Mar. 16, 2017

Related U.S. Application Data

(60) Provisional application No. 62/216,843, filed on Sep. 10, 2015.

(51) Int. Cl.

| | |
|---|---|
| ***E21B 17/00*** | (2006.01) |
| ***E21B 41/00*** | (2006.01) |
| ***E21B 17/046*** | (2006.01) |

(52) U.S. Cl.

CPC ..... *E21B 41/00* (2013.01); *E21B 17/046* (2013.01)

(58) Field of Classification Search

CPC ..... E21B 41/00; E21B 17/046

See application file for complete search history.

(56) References Cited

U.S. PATENT DOCUMENTS

| | | | |
|---|---|---|---|
| 1,367,156 A | 2/1921 | McAlvay et al. | |
| 1,822,444 A | 9/1931 | MacClatchie | |
| 2,370,354 A | 2/1945 | Hurst | |
| 3,147,992 A | 9/1964 | Haeber et al. | |
| 3,198,555 A * | 8/1965 | Elmer Johnson | E21B 17/046 285/330 |
| 3,354,951 A | 11/1967 | Savage et al. | |
| 3,385,370 A | 5/1968 | Knox et al. | |
| 3,662,842 A | 5/1972 | Bromell | |
| 3,698,426 A | 10/1972 | Litchfield et al. | |
| 3,747,675 A | 7/1973 | Brown | |

(Continued)

FOREIGN PATENT DOCUMENTS

| | | |
|---|---|---|
| AU | 2012201644 A1 | 4/2012 |
| AU | 2013205714 A1 | 5/2013 |

(Continued)

OTHER PUBLICATIONS

PCT International Search Report and Written Opinion dated Feb. 20, 2017 for International Application No. PCT/US2016/050139.

(Continued)

*Primary Examiner* — Matthew R Buck

*Assistant Examiner* — Aaron L Lembo

(74) *Attorney, Agent, or Firm* — Patterson + Sheridan, LLP

(57) ABSTRACT

The present disclosure generally relates to a modular connection system for a top drive. The modular connection system may include two tubular components, each having a bore, a seal profile, and two or more load transfer features. The first tubular component may be inserted to the second tubular component to make a connection to transfer fluid, axial loads, and torsional loads. Each of the two tubular components may also include a coupler configured to transfer pressured fluid, data, or other signals.

7 Claims, 20 Drawing Sheets

(56) References Cited

U.S. PATENT DOCUMENTS 3,766,991 A 10/1973 Brown
3,774,697 A 11/1973 Brown
3,776,320 A 12/1973 Brown
3,842,619 A 10/1974 Bychurch, Sr.
3,888,318 A 6/1975 Brown
3,899,024 A 8/1975 Tonnelli et al.
3,913,687 A 10/1975 Gyongyosi et al.
3,915,244 A 10/1975 Brown
3,964,552 A 6/1976 Slator
4,022,284 A 5/1977 Crow
4,051,587 A 10/1977 Boyadjieff
4,100,968 A 7/1978 Delano
4,192,155 A 3/1980 Gray
4,199,847 A * 4/1980 Owens ..... E21B 19/004 188/67
4,235,469 A 11/1980 Denny et al.
4,364,407 A 12/1982 Hilliard
4,377,179 A 3/1983 Giebeler
4,402,239 A 9/1983 Mooney
4,449,596 A 5/1984 Boyadjieff
4,478,244 A 10/1984 Garrett
4,497,224 A 2/1985 Jürgens
4,593,773 A 6/1986 Skeie
4,762,187 A 8/1988 Haney
4,776,617 A 10/1988 Sato
4,779,688 A 10/1988 Baugh
4,791,997 A 12/1988 Krasnov
4,813,493 A 3/1989 Shaw et al.
4,815,546 A 3/1989 Haney et al.
4,821,814 A 4/1989 Willis et al.
4,844,181 A 7/1989 Bassinger
4,867,236 A 9/1989 Haney et al.
4,955,949 A 9/1990 Bailey et al.
4,962,819 A 10/1990 Bailey et al.
4,972,741 A 11/1990 Sibille
4,981,180 A 1/1991 Price
4,997,042 A 3/1991 Jordan et al.
5,036,927 A 8/1991 Willis
5,099,725 A 3/1992 Bouligny, Jr. et al.
5,152,554 A 10/1992 LaFleur et al.
5,172,940 A 12/1992 Usui et al.
5,191,939 A 3/1993 Stokley
5,215,153 A 6/1993 Younes
5,245,877 A 9/1993 Ruark
5,282,653 A 2/1994 LaFleur et al.
5,297,833 A 3/1994 Willis et al.
5,348,351 A 9/1994 LaFleur et al.
5,385,514 A 1/1995 Dawe
5,433,279 A 7/1995 Tessari et al.
5,441,310 A 8/1995 Barrett et al.
5,456,320 A 10/1995 Baker
5,479,988 A 1/1996 Appleton
5,486,223 A 1/1996 Carden
5,501,280 A 3/1996 Brisco
5,509,442 A 4/1996 Claycomb
5,577,566 A 11/1996 Albright et al.
5,584,343 A 12/1996 Coone
5,607,250 A * 3/1997 Tatterson ..... E21B 17/046 166/377
5,645,131 A 7/1997 Trevisani
5,664,310 A 9/1997 Penisson
5,682,952 A 11/1997 Stokley
5,735,348 A 4/1998 Hawkins, III
5,778,742 A 7/1998 Stuart
5,839,330 A 11/1998 Stokka
5,909,768 A 6/1999 Castille et al.
5,918,673 A 7/1999 Hawkins et al.
5,950,724 A 9/1999 Giebeler
5,971,079 A 10/1999 Mullins
5,992,520 A 11/1999 Schultz et al.
6,003,412 A 12/1999 Dlask et al.
6,053,191 A 4/2000 Hussey
6,102,116 A 8/2000 Giovanni
6,142,545 A 11/2000 Penman et al.
6,161,617 A 12/2000 Gjedebo
6,173,777 B1 1/2001 Mullins
6,276,450 B1 8/2001 Seneviratne
6,279,654 B1 8/2001 Mosing et al.
6,289,911 B1 9/2001 Majkovic
6,309,002 B1 10/2001 Bouligny
6,311,792 B1 11/2001 Scott et al.
6,328,343 B1 12/2001 Hosie et al.
6,378,630 B1 4/2002 Ritorto et al.
6,390,190 B2 5/2002 Mullins
6,401,811 B1 6/2002 Coone
6,415,862 B1 7/2002 Mullins
6,431,626 B1 8/2002 Bouligny
6,443,241 B1 9/2002 Juhasz et al.
6,460,620 B1 10/2002 LaFleur
6,527,047 B1 3/2003 Pietras
6,536,520 B1 3/2003 Snider et al.
6,571,876 B2 6/2003 Szarka
6,578,632 B2 6/2003 Mullins
6,595,288 B2 7/2003 Mosing et al.
6,604,578 B2 8/2003 Mullins
6,622,796 B1 9/2003 Pietras
6,637,526 B2 10/2003 Juhasz et al.
6,640,824 B2 11/2003 Majkovic
6,666,273 B2 12/2003 Laurel
6,675,889 B1 1/2004 Mullins et al.
6,679,333 B2 1/2004 York et al.
6,688,398 B2 2/2004 Pietras
6,691,801 B2 2/2004 Juhasz et al.
6,705,405 B1 3/2004 Pietras
6,715,542 B2 4/2004 Mullins
6,719,046 B2 4/2004 Mullins
6,722,425 B2 4/2004 Mullins
6,725,938 B1 4/2004 Pietras
6,732,819 B2 5/2004 Wenzel
6,732,822 B2 5/2004 Slack et al.
6,742,584 B1 6/2004 Appleton
6,742,596 B2 6/2004 Haugen
6,779,599 B2 8/2004 Mullins et al.
6,832,656 B2 12/2004 Fournier, Jr. et al.
6,883,605 B2 4/2005 Arceneaux et al.
6,892,835 B2 5/2005 Shahin et al.
6,908,121 B2 6/2005 Hirth et al.
6,925,807 B2 8/2005 Jones et al.
6,938,697 B2 9/2005 Haugen
6,976,298 B1 12/2005 Pietras
6,994,176 B2 2/2006 Shahin et al.
7,000,503 B2 2/2006 Dagenais et al.
7,001,065 B2 2/2006 Dishaw et al.
7,004,259 B2 2/2006 Pietras
7,007,753 B2 3/2006 Robichaux et al.
7,017,671 B2 3/2006 Williford
7,021,374 B2 4/2006 Pietras
7,025,130 B2 4/2006 Bailey et al.
7,073,598 B2 7/2006 Haugen
7,090,021 B2 8/2006 Pietras
7,096,948 B2 8/2006 Mosing et al.
7,114,235 B2 10/2006 Jansch et al.
7,128,161 B2 10/2006 Pietras
7,137,454 B2 11/2006 Pietras
7,140,443 B2 11/2006 Beierbach et al.
7,143,849 B2 12/2006 Shahin et al.
7,147,254 B2 12/2006 Niven et al.
7,159,654 B2 1/2007 Ellison et al.
7,178,612 B2 2/2007 Belik
7,213,656 B2 5/2007 Pietras
7,219,744 B2 5/2007 Pietras
7,231,969 B2 6/2007 Folk et al.
7,270,189 B2 9/2007 Brown et al.
7,281,451 B2 10/2007 Beckinghausen
7,281,587 B2 10/2007 Haugen
7,303,022 B2 12/2007 Tilton et al.
7,325,610 B2 2/2008 Giroux et al.
7,353,880 B2 4/2008 Pietras
7,448,456 B2 11/2008 Shahin et al.
7,451,826 B2 11/2008 Pietras
7,490,677 B2 2/2009 Buytaert et al.
7,503,397 B2 3/2009 Giroux et al.
7,509,722 B2 3/2009 Shahin et al.
7,513,300 B2 4/2009 Pietras et al.

(56) References Cited

U.S. PATENT DOCUMENTS 7,591,304 B2 9/2009 Juhasz et al.
7,617,866 B2 11/2009 Pietras
7,635,026 B2 12/2009 Mosing et al.
7,665,515 B2 2/2010 Mullins
7,665,530 B2 2/2010 Wells et al.
7,665,531 B2 2/2010 Pietras
7,669,662 B2 3/2010 Pietras
7,690,422 B2 4/2010 Swietlik et al.
7,694,730 B2 4/2010 Angman
7,694,744 B2 4/2010 Shahin
7,699,121 B2 4/2010 Juhasz et al.
7,712,523 B2 5/2010 Snider et al.
7,730,698 B1 6/2010 Montano et al.
7,757,759 B2 7/2010 Jahn et al.
7,779,922 B1 8/2010 Harris et al.
7,793,719 B2 9/2010 Snider et al.
7,817,062 B1 10/2010 Li et al.
7,828,085 B2 11/2010 Kuttel et al.
7,841,415 B2 11/2010 Winter
7,854,265 B2 12/2010 Zimmermann
7,866,390 B2 1/2011 Latiolais, Jr. et al.
7,874,352 B2 1/2011 Odell, II et al.
7,874,361 B2 1/2011 Mosing et al.
7,878,237 B2 2/2011 Angman
7,878,254 B2 2/2011 Abdollahi et al.
7,882,902 B2 2/2011 Boutwell, Jr.
7,896,084 B2 3/2011 Haugen
7,918,273 B2 4/2011 Snider et al.
7,958,787 B2 6/2011 Hunter
7,971,637 B2 7/2011 Duhon et al.
7,975,768 B2 7/2011 Fraser et al.
8,118,106 B2 2/2012 Wiens et al.
8,141,642 B2 3/2012 Olstad et al.
8,210,268 B2 7/2012 Heidecke et al.
8,281,856 B2 10/2012 Jahn et al.
8,307,903 B2 11/2012 Redlinger et al.
8,365,834 B2 2/2013 Liess et al.
8,459,361 B2 * 6/2013 Leuchtenberg ..... E21B 17/07 166/355
8,505,984 B2 8/2013 Henderson et al.
8,567,512 B2 10/2013 Odell, II et al.
8,601,910 B2 12/2013 Begnaud
8,636,067 B2 1/2014 Robichaux et al.
8,651,175 B2 2/2014 Fallen
8,668,003 B2 3/2014 Osmundsen et al.
8,708,055 B2 4/2014 Liess et al.
8,727,021 B2 5/2014 Heidecke et al.
8,776,898 B2 7/2014 Liess et al.
8,783,339 B2 7/2014 Sinclair et al.
8,839,884 B2 9/2014 Kuttel et al.
8,893,772 B2 11/2014 Henderson et al.
9,068,406 B2 6/2015 Clasen et al.
9,206,851 B2 12/2015 Slaughter, Jr. et al.
9,528,326 B2 12/2016 Heidecke et al.
9,631,438 B2 * 4/2017 McKay ..... E21B 33/035
2002/0043403 A1 4/2002 Juhasz et al.
2002/0074132 A1 6/2002 Juhasz et al.
2002/0084069 A1 7/2002 Mosing et al.
2002/0129934 A1 9/2002 Mullins et al.
2002/0170720 A1 11/2002 Haugen
2003/0098150 A1 5/2003 Andreychuk
2003/0107260 A1 6/2003 Ording et al.
2003/0221519 A1 12/2003 Haugen
2004/0003490 A1 1/2004 Shahin et al.
2004/0069497 A1 4/2004 Jones et al.
2004/0216924 A1 11/2004 Pietras et al.
2005/0000691 A1 1/2005 Giroux et al.
2005/0173154 A1 8/2005 Lesko
2005/0206163 A1 9/2005 Guesnon et al.
2005/0257933 A1 11/2005 Pietras
2005/0269072 A1 12/2005 Folk et al.
2005/0269104 A1 12/2005 Folk et al.
2005/0269105 A1 12/2005 Pietras
2005/0274508 A1 12/2005 Folk et al.
2006/0037784 A1 2/2006 Walter et al.
2006/0124353 A1 6/2006 Juhasz et al.
2006/0151181 A1 7/2006 Shahin
2006/0180315 A1 8/2006 Shahin et al.
2007/0030167 A1 2/2007 Li et al.
2007/0044973 A1 3/2007 Fraser et al.
2007/0074588 A1 4/2007 Harata et al.
2007/0074874 A1 4/2007 Richardson
2007/0102992 A1 5/2007 Jager
2007/0131416 A1 6/2007 Odell, II et al.
2007/0140801 A1 6/2007 Kuttel et al.
2007/0144730 A1 6/2007 Shahin et al.
2007/0158076 A1 7/2007 Hollingsworth, Jr. et al.
2007/0251701 A1 11/2007 Jahn et al.
2008/0059073 A1 3/2008 Giroux et al.
2008/0093127 A1 4/2008 Angman
2008/0099196 A1 5/2008 Latiolais et al.
2008/0125876 A1 5/2008 Boutwell
2008/0202812 A1 8/2008 Childers et al.
2008/0308281 A1 12/2008 Boutwell, Jr. et al.
2009/0151934 A1 6/2009 Heidecke et al.
2009/0159294 A1 6/2009 Abdollahi et al.
2009/0200038 A1 8/2009 Swietlik et al.
2009/0205820 A1 8/2009 Koederitz et al.
2009/0205827 A1 8/2009 Swietlik et al.
2009/0205836 A1 8/2009 Swietlik et al.
2009/0205837 A1 8/2009 Swietlik et al.
2009/0229837 A1 9/2009 Wiens et al.
2009/0266532 A1 10/2009 Revheim et al.
2009/0272537 A1 11/2009 Alikin et al.
2009/0274544 A1 11/2009 Liess
2009/0274545 A1 11/2009 Liess et al.
2009/0321086 A1 12/2009 Zimmermann
2010/0032162 A1 2/2010 Olstad et al.
2010/0101805 A1 4/2010 Angelle et al.
2010/0200222 A1 8/2010 Robichaux et al.
2010/0206583 A1 8/2010 Swietlik et al.
2010/0206584 A1 8/2010 Clubb et al.
2011/0036586 A1 2/2011 Hart et al.
2011/0039086 A1 2/2011 Graham et al.
2011/0088495 A1 4/2011 Buck et al.
2011/0214919 A1 9/2011 McClung, III
2011/0280104 A1 11/2011 McClung, III
2012/0048574 A1 3/2012 Wiens et al.
2012/0152530 A1 6/2012 Wiedecke et al.
2012/0160517 A1 6/2012 Bouligny et al.
2012/0212326 A1 8/2012 Christiansen et al.
2012/0234107 A1 9/2012 Pindiprolu et al.
2012/0298376 A1 11/2012 Twardowski
2013/0055858 A1 3/2013 Richardson
2013/0056977 A1 3/2013 Henderson et al.
2013/0062074 A1 3/2013 Angelle et al.
2013/0075077 A1 3/2013 Henderson et al.
2013/0075106 A1 3/2013 Tran et al.
2013/0105178 A1 5/2013 Pietras
2013/0207382 A1 8/2013 Robichaux
2013/0207388 A1 8/2013 Jansson et al.
2013/0233624 A1 9/2013 In
2013/0269926 A1 10/2013 Liess et al.
2013/0271576 A1 10/2013 Elllis
2013/0275100 A1 10/2013 Ellis et al.
2013/0299247 A1 11/2013 Küttel et al.
2014/0090856 A1 4/2014 Pratt et al.
2014/0116686 A1 5/2014 Odell, II et al.
2014/0131052 A1 5/2014 Richardson
2014/0202767 A1 7/2014 Feasey
2014/0233804 A1 8/2014 Gustavsson et al.
2014/0262521 A1 9/2014 Bradley et al.
2014/0305662 A1 10/2014 Giroux et al.
2014/0326468 A1 11/2014 Heidecke et al.
2014/0352944 A1 12/2014 Devarajan et al.
2014/0360780 A1 12/2014 Moss et al.
2015/0053424 A1 2/2015 Wiens et al.
2015/0083391 A1 * 3/2015 Bangert ..... E21B 19/07 166/77.52
2015/0107385 A1 4/2015 Mullins et al.
2015/0337648 A1 11/2015 Zippel et al.
2016/0024862 A1 1/2016 Wilson et al.
2016/0138348 A1 5/2016 Kunec
2016/0145954 A1 5/2016 Helms et al.

(56) References Cited

U.S. PATENT DOCUMENTS

| | | | | |
|---|---|---|---|---|
| 2016/0215592 | A1* | 7/2016 | Helms | E21B 19/16 |
| 2016/0230481 | A1 | 8/2016 | Misson et al. | |
| 2016/0340982 | A1* | 11/2016 | Partouche | E21B 17/028 |
| 2017/0037683 | A1 | 2/2017 | Heidecke et al. | |
| 2017/0044854 | A1 | 2/2017 | Hebebrand et al. | |
| 2017/0044875 | A1 | 2/2017 | Hebebrand et al. | |
| 2017/0051568 | A1 | 2/2017 | Wern et al. | |
| 2017/0067303 | A1 | 3/2017 | Thiemann et al. | |
| 2017/0067320 | A1 | 3/2017 | Zouhair et al. | |
| 2017/0074075 | A1 | 3/2017 | Liess | |
| 2017/0211327 | A1 | 7/2017 | Wern et al. | |
| 2017/0211343 | A1* | 7/2017 | Thiemann | E21B 17/042 |
| 2017/0284164 | A1 | 10/2017 | Holmes et al. | |

FOREIGN PATENT DOCUMENTS

| | | | |
|---|---|---|---|
| AU | 2014215938 | A1 | 9/2014 |
| CA | 2 707 050 | A1 | 6/2009 |
| CA | 2 841 654 | A1 | 8/2015 |
| CA | 2 944 327 | A1 | 10/2015 |
| EP | 0 250 072 | B1 | 4/1991 |
| EP | 1 619 349 | A2 | 1/2006 |
| EP | 1 772 715 | A2 | 4/2007 |
| EP | 1 961 912 | A1 | 8/2008 |
| EP | 1 961 913 | A1 | 8/2008 |
| EP | 2 322 357 | A1 | 5/2011 |
| GB | 1487948 | A | 10/1977 |
| GB | 2 077 812 | A | 12/1981 |
| GB | 2 180 027 | A | 3/1987 |
| GB | 2 228 025 | A | 8/1990 |
| GB | 2314391 | A | 12/1997 |
| WO | 2004/079153 | A2 | 9/2004 |
| WO | 2004/101417 | A2 | 11/2004 |
| WO | 2007/001887 | A2 | 1/2007 |
| WO | 2007/070805 | A2 | 6/2007 |
| WO | 2009/076648 | A2 | 6/2009 |
| WO | 2012/115717 | A2 | 8/2012 |
| WO | 2015/000023 | A1 | 1/2015 |
| WO | 2015/127433 | A1 | 8/2015 |
| WO | 2015119509 | A1 | 8/2015 |
| WO | 2015176121 | A1 | 11/2015 |

OTHER PUBLICATIONS

A123 System; 14Ah Prismatic Pouch Cell; Nanophosphate® Lithium-Ion; www.a123systems.com; date unknown; 1 page.
Streicher Load/Torque Cell Systems; date unknown; 1 page.
3PS, Inc.; Enhanced Torque and Tension Sub with Integrated Turns; date unknown; 2 total pages.
Lefevre, et al.; Drilling Technology; Deeper, more deviated wells push development of smart drill stem rotary shouldered connections; dated 2008; 2 total pages.
PCT Invitaiton to Pay Additional Fees for International Application No. PCT/US2008/086699; dated Sep. 9, 2009; 7 total pages.
PCT Notification of Transmittal of the International Search Report and the Written Opinion of the International Searching Authority for International Application No. PCT/US2008/086699; dated Sep. 11, 2009; 19 total pages.
National Oilwell Varco; Rotary Shoulder Handbook; dated 2010; 116 total pages.
Weatherford; TorkSub™ Stand-Alone Torque Measuring System; dated 2011-2014; 4 total pages.
Australian Examination Report for Application No. 2008334992; dated Apr. 5, 2011; 2 total pages.
European Search Report for Application No. 08 860 261.0-2315; dated Apr. 12, 2011; 4 total pages.
Eaton; Spool Valve Hydraulic Motors; dated Sep. 2011; 16 total pages.
European Extended Search Report for Application No. 12153779.9-2315; dated Apr. 5, 2012; 4 total pages.
Australian Examination Report for Application No. 2012201644; dated May 15, 2013; 3 total pages.
Warrior; 250E Electric Top Drive (250-TON); 250H Hydraulic Top Drive (250-TON); dated Apr. 2014; 4 total pages.
Hydraulic Pumps & Motors; Fundamentals of Hydraulic Motors; dated Jun. 26, 2014; 6 total pages.
Warrior; Move Pipe Better; 500E Electric Top Drive (500 ton-1000 hp); dated May 2015; 4 total pages.
Canadian Office Action for Application No. 2,837,581; dated Aug. 24, 2015; 3 total pages.
European Extended Search Report for Application No. 15166062.8-1610; dated Nov. 23, 2015; 6 total pages.
Australian Examination Report for Application No. 2014215938; dated Feb. 4, 2016; 3 total pages.
Rexroth; Bosch Group; Motors and Gearboxes; Asynchronous high-speed motors 1 MB for high speeds; dated Apr. 13, 2016; 6 total pages.
Canadian Office Action for Application No. 2,837,581; dated Apr. 25, 2016; 3 total pages.
PCT Notification of Transmittal of the International Search Report and the Written Opinion of the International Searching Authority for International Application No. PCT/US2015/061960; dated Jul. 25, 2016; 16 total pages.
PCT Notification of Transmittal of the International Search Report and the Written Opinion of the International Searching Authority for International Application No. PCT/US2016/049462; dated Nov. 22, 2016; 14 total pages.
PCT Notification of Transmittal of the International Search Report and the Written Opinion of the International Searching Authority for International Application No. PCT/US2016/050542; dated Nov. 25, 2016; 13 total pages.
PCT Notification of Transmittal of the International Search Report and the Written Opinion of the International Searching Authority for International Application No. PCT/US2016/046458; dated Dec. 14, 2016; 16 total pages.
PCT Notification of Transmittal of the International Search Report and the Written Opinion of the International Searching Authority for International Application No. PCT/US2016/047813; dated Jan. 12, 2017; 15 total pages.
PCT Notification of Transmittal of the International Search Report and the Written Opinion of the International Searching Authority for International Application No. PCT/US2017/014646; dated Apr. 4, 2017; 14 total pages.
PCT Notification of Transmittal of the International Search Report and the Written Opinion of the International Searching Authority for International Application No. PCT/US2017/014224; dated Jun. 8, 2017; 15 total pages.
European Extended Search Report for Application No. 17152458.0-1609; dated Jun. 8, 2017; 7 total pages.
Australian Examination Report for Application No. 2017200371; dated Sep. 19, 2017; 5 total pages.
European Extended Search Report for Application No. 17195552.9-1614; dated Dec. 4, 2017; 6 total pages.
Australian Examination Report for Application No. 2017200371; dated Feb. 8, 2018; 6 total pages.
Canadian Office Action for Application No. 2,955,754; dated Mar. 28, 2018; 3 total pages.
Australian Examination Report for Application No. 2017200371; dated May 2, 2018; 4 total pages.
Canadian Office Action for Application No. 2,974,298; dated May 16, 2018; 3 total pages.
European Patent Office; Extended European Search Report for Application No. 18157915.2; dated Jun. 6, 2018; 8 total pages.
Canadian Office Action in related application CA 2,955,754 dated Jul. 17, 2018.
EPO Extended European Search Report dated Jul. 19, 2018, for European Application No. 18159595.0.
EPO Extended European Search Report dated Jul. 17, 2018, for European Application No. 18158050.7.
Cookson, Colter, "Inventions Speed Drilling, Cut Costs," The American Oil & Gas Reporter, Sep. 2015, 2 pages.
Ennaifer, Amine et al. , "Step Change in Well Testing Operations," Oilfield Review, Autumn 2014: 26, No. 3, pp. 32-41.
Balltec Lifting Solutions, LiftLOK™ Brochure, "Highest integrity lifting tools for the harshest environments," 2 pages.

(56) References Cited

OTHER PUBLICATIONS

Balltec Lifting Solutions, CoilLOK™ Brochure, "Highest integrity hand-held coiled tubing handling tools," 2 pages.
Peters; Tool Coupler for Use With a Top Drive; U.S. Appl. No. 15/656,508, filed Jul. 21, 2017. (Application not attached to IDS.).
Fuehring et al.; Tool Coupler With Rotating Coupling Method for Top Drive; U.S. Appl. No. 15/445,758, filed Feb. 28, 2017. (Application not attached to IDS.).
Bell; Interchangeable Swivel Combined Multicoupler; U.S. Appl. No. 15/607,159, filed May 26, 2017 (Application not attached to IDS.).
Amezaga; Dual Torque Transfer for Top Drive System; U.S. Appl. No. 15/447,881, filed Mar. 2, 2017. (Application not attached to IDS.).
Zouhair; Coupler With Threaded Connection for Pipe Handler; U.S. Appl. No. 15/444,016, filed Feb. 27, 2017. (Application not attached to IDS.).
Liess; Downhole Tool Coupling System; U.S. Appl. No. 15/670,897, filed Aug. 7, 2017. Application not attached to IDS.).
Muller et al; Combined Multi-Coupler With Rotating Locking Method for Top Drive; U.S. Appl. No. 15/721,216, filed Sep. 29, 2017. (Application not attached to IDS.).
Amezaga et al; Tool Coupler With Threaded Connection for Top Drive; U.S. Appl. No. 15/457,572, filed Mar. 13, 2017. (Application not attached to IDS.).
Wiens; Combined Multi-Coupler With Locking Clamp Connection for Top Drive; U.S. Appl. No. 15/627,428, filed Jun. 19, 2017. (Application not attached to IDS.).
Henke et al.; Tool Coupler With Sliding Coupling Members for Top Drive; U.S. Appl. No. 15/448,297, filed Mar. 2, 2017. (Application not attached to IDS.).
Schoknecht et al.; Combined Multi-Coupler With Rotating Fixations for Top Drive; U.S. Appl. No. 15/447,926, filed Mar. 2, 2017. (Application not attached to IDS.).
Metzlaff et al.; Combined Multi-Coupler for Top Drive; U.S. Appl. No. 15/627,237, filed Jun. 19, 201T (Application not attached to IDS.).
Liess; Combined Multi-Coupler for Top Drive; U.S. Appl. No. 15/656,914, filed Jul. 21, 2017. (Application not attached to IDS.).
Liess et al.; Combined Multi-Coupler; U.S. Appl. No. 15/656,684, filed Jul. 21, 2017. (Application not attached to IDS).
Amezaga et al.; Tool Coupler With Data and Signal Transfer Methods for Top Drive; U.S. Appl. No. 15/730,305, filed Oct. 11, 2017. (Application not attached to IDS).
Liess; Tool Coupler With Threaded Connection for Top Drive; U.S. Appl. No. 15/806,560, filed Nov. 8, 2017. (Application not attached to IDS).

* cited by examiner

FIG. 14J
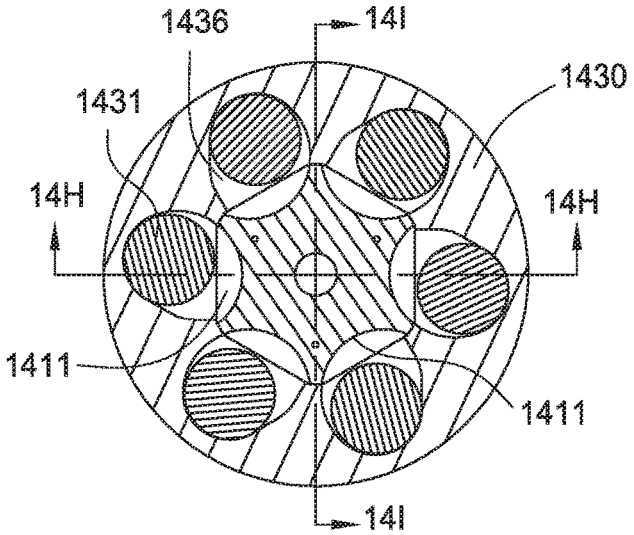
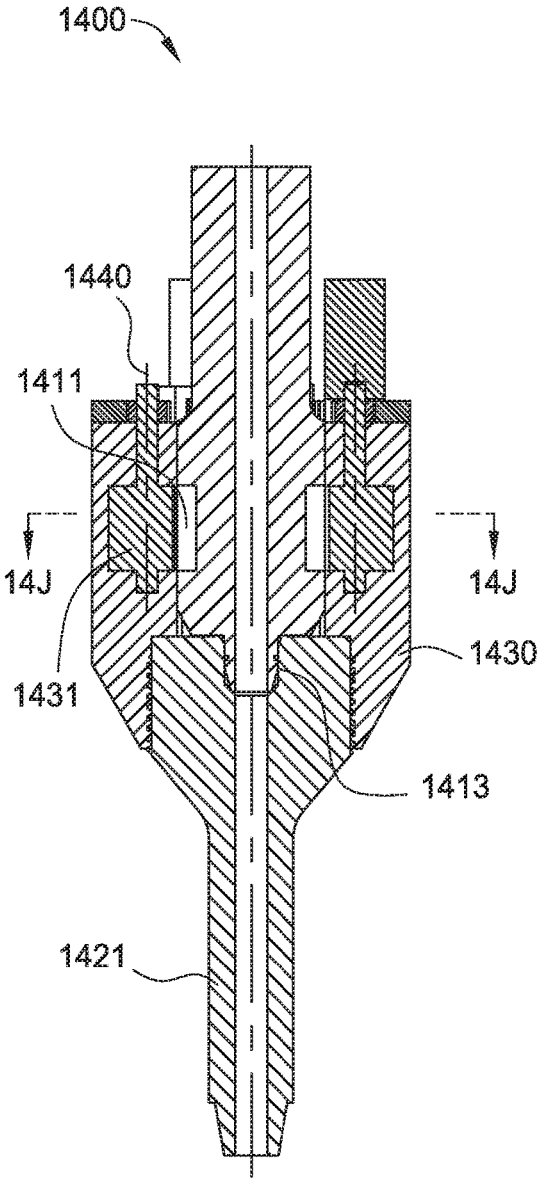
FIG. 14H
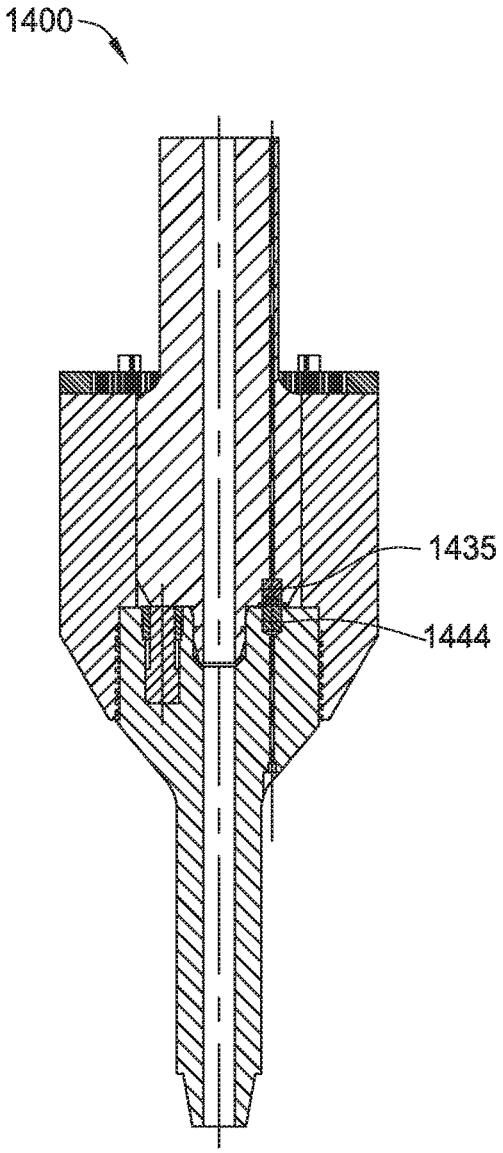
FIG. 14I

MODULAR CONNECTION SYSTEM FOR TOP DRIVE

This application claims benefit of U.S. Provisional Patent Application No. 62/216,843, filed Sep. 10, 2015, and entitled "MODULAR CONNECTION SYSTEM FOR TOP DRIVE" which is herein incorporated by reference in its entirety.

BACKGROUND OF THE DISCLOSURE

Field of the Disclosure

The present disclosure generally relates to a modular connection system for a top drive.

Description of the Related Art

A wellbore is formed to access hydrocarbon-bearing formations (e.g., crude oil and/or natural gas) or for geothermal power generation by the use of drilling. Drilling is accomplished by utilizing a drill bit that is mounted on the end of a drill string. To drill within the wellbore to a predetermined depth, the drill string is often rotated by a top drive on a drilling rig. After drilling to a predetermined depth, the drill string and drill bit are removed and a string of casing is lowered into the wellbore. An annulus is thus formed between the casing string and the wellbore. The casing string is hung from the wellhead. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

During a drilling and well construction operation, various tools are used which have to be attached to the top drive. The process of changing tools is very time consuming and dangerous requiring personnel to work at heights.

SUMMARY OF THE DISCLOSURE

The present disclosure generally relates to a modular connection system for a top drive. In one embodiment, a modular connection system includes a first tubular component having a first bore therethrough and a second tubular component having a second bore. The first tubular component includes a first seal profile around the first bore, and one or more first load transfer features. The second tubular component includes a second seal profile around the second bore, wherein the first seal profile is shaped to match the second seal profile and form a fluid connection between the first and second bores, and one or more second load transfer features matching the one or more first load transfer features of the first tubular component. The first tubular component may be inserted to the second tubular component to make a connection to transfer fluid, axial loads, and torsional loads.

In one embodiment, a modular connection system for a top drive includes: a housing having a bore therethrough; a plurality of latch blocks disposed in the housing and movable relative thereto between an extended position and a retracted position; a stem insertable into the housing bore and having a shoulder formed in an outer surface thereof for mating with the latch blocks in the extended position; a torsional profile formed in one of an inner and outer surface of the housing; and a torsional coupling formed in or attached to the other one of an outer and inner surface of the stem. Each torsional coupling is engaged with the torsional profile when the latch blocks are engaged with the shoulder.

Another embodiment provides a drive stem adapted to connect with a top drive. The drive stem includes a body having a bore therethrough, a seal profile around the bore, one or more load transfer features formed on an outer surface of the body, and one or more couplers disposed on the body to transfer pressured fluid, data, or other signals.

Another embodiment provides a tool dock. The tool dock includes a stem having a bore, a housing having one or more load transfer features, and one or more couplers disposed on the housing to transfer pressured fluid, data, or other signals.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIGS. 14A-14M illustrates a modular connection system according to another embodiment of the present disclosure.

DETAILED DESCRIPTION

Figure 1:
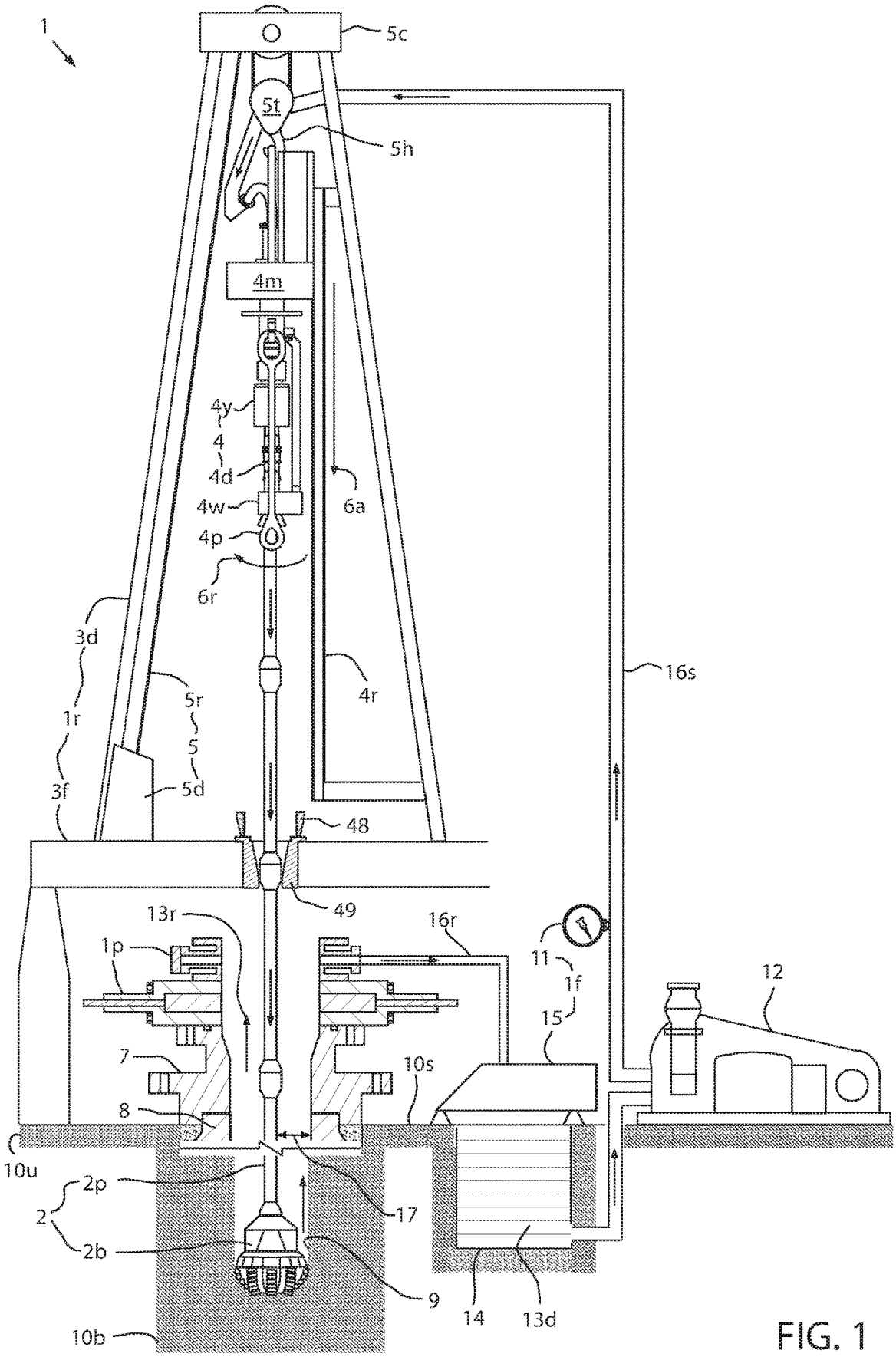
FIG. 1 illustrates a drilling system in a drilling mode, according to one embodiment of the present disclosure.

FIG. 1 illustrates a drilling system 1 in a drilling mode, according to one embodiment of the present disclosure. The drilling system 1 may include a drilling rig 1*r*, a fluid handling system 1*f*, a pressure control assembly (PCA) 1*p*, and a drill string 2. The drilling rig 1*r* may include a derrick 3*d*, a floor 3*f*, a top drive 4, and a hoist 5. The rig floor 3*f* may have an opening through which the drill string 2 extends downwardly into the PCA 1*p*.

The drill string 2 may include a bottomhole assembly (BHA) and a pipe string 2*p*. The pipe string 2*p* may include joints of drill pipe connected together, such as by threaded couplings. The BHA may be connected to the pipe string 2*p*, such as by threaded couplings. The BHA may include one or more drill collars (not shown) and a drill bit 2*b*. Each BHA component may be connected to adjacent component(s), such as by threaded couplings. The drill bit 2*b* may be rotated 6*r* by the top drive 4 via the pipe string 2*p* and/or the BHA may further include a drilling motor (not shown) for rotating the drill bit. The BHA may further include an instrumentation sub (not shown), such as a measurement while drilling (MWD) and/or a logging while drilling (LWD) sub.

An upper end of the pipe string 2*p* may be connected to the top drive 4, such as by threaded couplings. The top drive 4 may include a control unit 4*n* (FIG. 2), a motor unit 4*m*, a drilling unit 4*d*, a casing unit 4*c* (FIG. 7A), a cementing unit 4*s* (FIG. 8B), a pipe handler 4*p*, a backup wrench 4*w*, a rail 4*r*, and a modular connection system (MCS) 4*y*. The top drive 4 may be assembled as part of the drilling rig 1*r* by connecting ends of the rail 4*r* to the derrick 3*d* such that a front of the rail is adjacent to a drill string opening in the rig floor 3*f*. The rail 4*r* may have a length sufficient for the top drive 4 to handle stands (not shown) of two to four joints of drill pipe. The rail length may be greater than or equal to twenty-five meters and less than or equal to one hundred meters.

Alternatively, the top drive 4 may include twin rails instead of the monorail 4*r*. Alternatively, the lower end of the rail 4*r* may be connected to the rig floor 3*f* instead of the derrick 3*d*.

The hoist 5 may include a hook 5*h* carried by a traveling block 5*t* supported by wire rope 5*r*. An upper end of the wire ripe 5*r* may be coupled to a crown block 5*c*. The wire rope 5*r* may be woven through sheaves of the blocks 5*c,t* and extend to drawworks 5*d* for reeling thereof, thereby raising or lowering the traveling block 5*t* relative to the derrick 3*d*.

The PCA 1*p* may include a blowout preventer (BOP) and a flow cross. A housing of the BOP and the flow cross may each be interconnected and/or connected to a wellhead 7, such as by a flanged connection. The wellhead 7 may be mounted on a casing string 8 which has been deployed into a wellbore 9 drilled from a surface 10*s* of the earth and cemented into the wellbore. The casing string 8 may extend to a depth adjacent a bottom of an upper formation 10*u*. The upper formation 10*u* may be non-productive and a lower formation 10*b* may be a hydrocarbon-bearing reservoir.

Alternatively, the lower formation 10*b* may be non-productive (e.g., a depleted zone), environmentally sensitive, such as an aquifer, or unstable. Alternatively, the wellbore 9 may be subsea having a wellhead located adjacent to the waterline and the drilling rig 1*r* may be a located on a platform adjacent the wellhead. Alternatively, the wellbore 9 may be subsea having a wellhead located adjacent to the seafloor and the drilling rig 1*r* may be a located on an offshore drilling unit.

The fluid system if may include a pressure gauge 11, a mud pump 12, a reservoir of drilling fluid 13*d*, such as a pit 14 or tank, a solids separator, such as a shale shaker 15, a return line 16*r*, a feed line, and a supply line 16*s*. A first end of the return line 16*r* may be connected to a branch of the flow cross and a second end of the return line may be connected to an inlet of the shaker 15. A lower end of the supply line 16*s* may be connected to an outlet of the mud pump 12 and an upper end of the supply line may be connected to the top drive 4. The pressure gauge 11 may be assembled as part of the supply line 16*s*. A lower end of the feed line may be connected to an outlet of the pit 14 and an upper end of the feed line may be connected to an inlet of the mud pump 12. The pressure gauge 11 may be used to monitor discharge pressure of the mud pump 12.

The drilling fluid 13*d* may include a base liquid. The base liquid may be refined and/or synthetic oil, water, brine, or a water/oil emulsion. The drilling fluid 13*d* may further include solids dissolved or suspended in the base liquid, such as organophilic clay, lignite, and/or asphalt, thereby forming a mud.

To extend the wellbore 9 from a shoe of the casing string 8 into the lower formation 10*b*, the mud pump 12 may pump the drilling fluid 13*d* from the pit 14, through the supply line 16*s* to the top drive 4. The drilling fluid 13*d* may flow from the supply line 16*s* and into the drill string 2 via the top drive 4. The drilling fluid 13*d* may be pumped down through the drill string 2 and exit the drill bit 2*b*, where the fluid may circulate the cuttings away from the bit and return the cuttings up an annulus 17 formed between an inner surface of the casing string 8 or wellbore 9 and an outer surface of the drill string 2. The returns 13*r* (drilling fluid plus cuttings) may flow up the annulus 17 to the wellhead 7 and exit the wellhead at the flow cross. The returns 13*r* may continue through the return line 16*r* and into the shale shaker 15 and be processed thereby to remove the cuttings, thereby completing a cycle. As the drilling fluid 13*d* and returns 13*r* circulate, the drill string 2 may be rotated 6*r* by the top drive 4 and lowered 6*a* by the traveling block 5*t*, thereby extending the wellbore 9 into the lower formation 10*b*.

Figure 2:
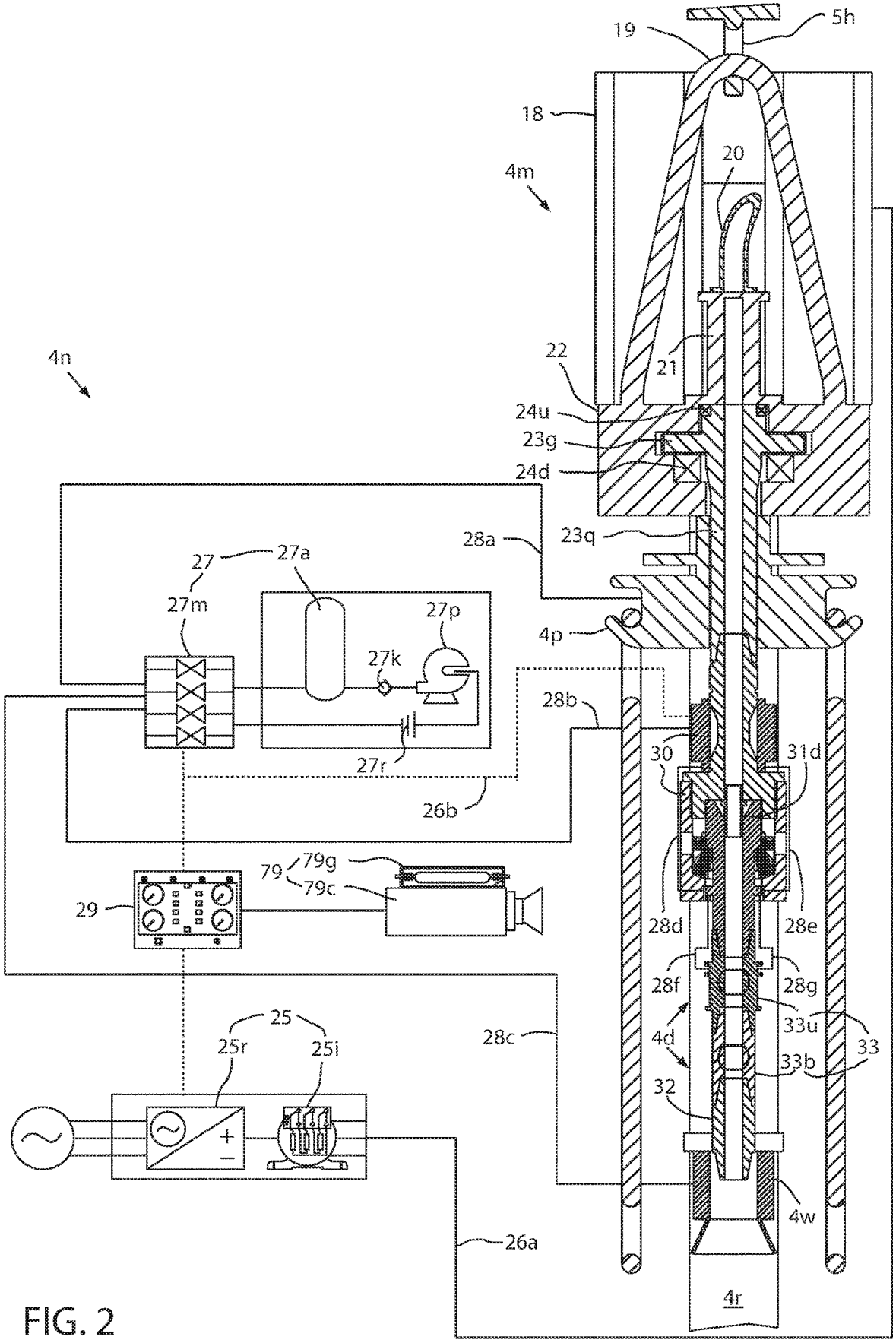
FIG. 2 illustrates a top drive of the drilling system.

FIG. 2 illustrates the top drive 4. The control unit 4*n* may be located on the rig floor 3*f* and include a hydraulic power unit (HPU) 27, a motor driver 25, and a control console 29. The HPU 27 may include a pump 27*p*, a check valve 27*k*, an accumulator 27*a*, a reservoir 27*r* of hydraulic fluid, and the manifold 27*m*. The motor driver 25 may be one or more (three shown) phase and include a rectifier 25*r* and an inverter 25*i*. The inverter 25*i* may be capable of speed control of the motor unit 4*m*, such as being a pulse width modulator. Each of the HPU manifold 27*m* and motor driver 25 may be in data communication with the control console 29 for control of the various functions of the top drive 4. The control unit 4*n* may further include a video monitoring unit 79 having a video camera 79*c* and a light source 79*g* such that a technician (not shown) may visually monitor operation thereof from the rig floor 3*f* or control room (not shown) especially during shifting of the modes. The video monitoring unit 79 may be mounted on the motor unit 4*m*.

The motor unit 4*m* may include one or more (pair shown) drive motors 18, a becket 19, a hose nipple 20, a mud swivel 21, a drive body 22, a drive ring, such as a gear 23*g*, a quill 23*q*, a trolley (not shown), a down thrust bearing 24*d*, and an up thrust bearing 24*u*. The drive body 22 may be rectangular, may have a thrust chamber formed therein, and may have a central opening formed therethrough. The drive gear 23*g* may be longitudinally and torsionally connected to the quill 23*q*. The drive motors 18 may be electric (shown) or hydraulic (not shown) and have a rotor and a stator. A stator of each drive motor 18 may be connected to the drive body 22, such as by fastening, and be in electrical communication with the motor driver 25 via a power cable 26*a*. The rotor of each drive motor 18 may be torsionally connected to the drive gear 23*g* for rotation 6*r* thereof.

Alternatively, the motor unit 4*m* may instead be a direct drive unit having the drive motor 18 centrally located.

Each thrust bearing 24*u,d* may include a shaft washer, a housing washer, a cage, and a plurality of rollers extending through respective openings formed in the cage. The shaft washer of the down thrust bearing 24*d* may be connected to the drive gear 23*g* adjacent to a bottom thereof. The housing washer of the down thrust bearing 24*d* may be connected to the drive body 22. The cage and rollers of the down thrust bearing 24*d* may be trapped between the washers thereof, thereby supporting rotation 6*r* of the drive gear 23*g* (and the quill 23*q*) relative to the drive body 22. The down thrust bearing 24*d* may be capable of sustaining weight of the drill string 2 during rotation thereof. The shaft washer of the up thrust bearing 24*u* may be connected to the drive gear 23*g* adjacent to a top thereof. The housing washer of the up thrust bearing 24*u* may be connected to the drive body 22. The cage and rollers of the up thrust bearing 24*u* may be trapped between the washers thereof.

The trolley may be connected to a back of the drive body 22, such as by fastening. The trolley may be transversely connected to a front of the rail 4*r* and may ride along the rail, thereby torsionally restraining the drive body 22 while allowing vertical movement of the motor unit 4*m* with the travelling block 5*t*. The becket 19 may be connected to the drive body 22, such as by fastening, and the becket may receive the hook 5*h* to suspend the motor unit 4*m* from the derrick 3*d*.

The hose nipple 20 may be connected to the mud swivel 21 and receive a mud hose of the supply line 16*s*. The mud hose may deliver the drilling fluid 13*d* from a standpipe of the supply line 16*s* to the hose nipple 20. The mud swivel 21 may have an outer non-rotating barrel connected to the hose nipple 20 and an inner rotating barrel. The mud swivel 21 may have a bearing (not shown) and a dynamic seal (not shown) for accommodating rotation of the rotating barrel relative to the non-rotating barrel. The outer non-rotating barrel may be connected to the drive body 22, such as by fastening. The inner rotating barrel may be disposed in the outer non-rotating barrel and have a stinger portion (not shown) extending therefrom. A lower end of the stinger portion may carry a stab seal for engagement with an inner seal receptacle of the quill 23*q*, thereby sealing an interface formed between the mud swivel 21 and the quill.

The pipe handler 4*p* may include a body, a drill pipe elevator (not shown), a pair of bails, and a link tilt (not shown). The handler body may be connected to a bottom of the drive body 22, such as by fastening. Each bail may have an eyelet formed at each longitudinal end thereof. An upper eyelet of each bail may be received by a respective knuckle of the handler body. The link tilt may include a pair of piston and cylinder assemblies for swinging the elevator relative to the handler body. Each piston and cylinder assembly may have a coupling, such as a hinge knuckle, formed at each longitudinal end thereof. An upper hinge knuckle of each piston and cylinder assembly may be received by a respective lifting lug of the handler body and pivotally connected thereto, such as by fastening. A lower hinge knuckle of each piston and cylinder assembly may be received by a complementary hinge knuckle of the respective bail and pivotally connected thereto, such as by fastening. A piston of each piston and cylinder assembly may be disposed in a bore of the respective cylinder. The piston may divide the cylinder bore into a raising chamber and a lowering chamber and the cylinder may have ports formed through a wall thereof and each port may be in fluid communication with a respective chamber.

Each port may be in fluid communication with the manifold 27*m* via a respective control line 28*a* (only one shown). Supply of hydraulic fluid to the raising port may lift the drill pipe elevator by increasing a tilt angle (measured from a longitudinal axis of the rail 4*r*). Supply of hydraulic fluid to the lowering port may drop the drill pipe elevator by decreasing the tilt angle. The drill pipe elevator may be manually opened and closed or the pipe handler 4*p* may include an actuator (not shown) for opening and closing the drill pipe elevator. The drill pipe elevator may include a bushing having a profile, such as a bottleneck, complementary to an upset formed in an outer surface of a joint of the drill pipe adjacent to the threaded coupling thereof. The bushing may receive the drill pipe for hoisting one or more joints thereof, such as the stand. The bushing may allow rotation of the stand relative to the pipe handler 4*p*. The pipe handler 4*p* may deliver the stand to the drill string 2 where the stand may be assembled therewith to extend the drill string during a drilling operation. The pipe handler 4*p* may be capable of supporting the weight of the drill string 2 to expedite tripping of the drill string.

The MCS 4*y* may include a latch head 30 and a stem 31*d,c,s* (31*c* in FIG. 7A, 31*s* in FIG. 8B) for the respective drilling 4*d*, casing 4*c*, and cementing 4*s* units. The drilling unit 4*d* may include the drilling stem 31*d*, a thread saver 32, and an internal blowout preventer (IBOP) 33. The components of the drilling unit 4*d* may be connected to each other by threaded couplings. The IBOP 33 may include one or more shutoff valves 33*u,b*. One 33*u* of the shutoff valves 33*u,b* may be automated and the other 33*b* may be manual. The automated IBOP valve actuator may include an opening port and/or a closing port and each port may be in fluid communication with the HPU manifold 27*m* via the control lines 28*f,g*.

Alternatively, the drilling unit 4*d* may include a power source, a controller, and a wireless data link for operation of the automated shutoff valve 33*u* via wireless command signal. Alternatively, the components of the drilling unit 4*d* may be integrated into a single tube.

Figure 3A:
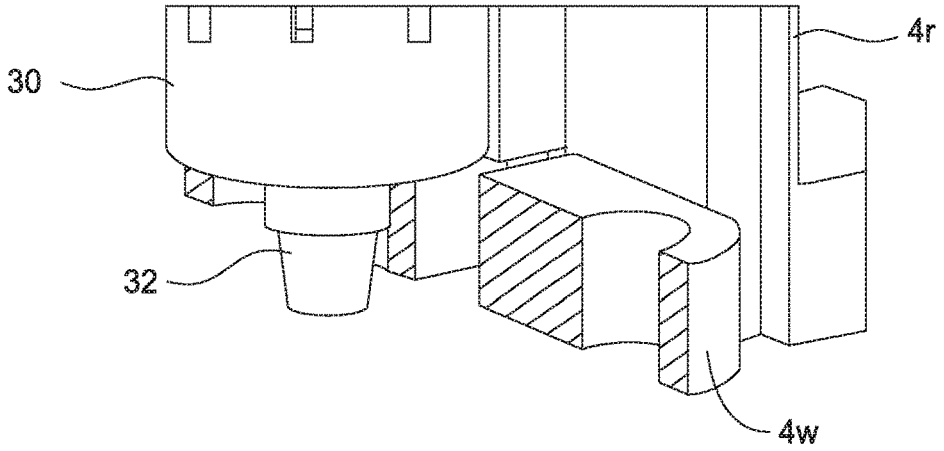
FIG. 3A illustrates a backup wrench of the top drive in a stowed position.

FIG. 3A illustrates the backup wrench 4*w* in a stowed position. The backup wrench 4*w* may include a pair of hinges, a tong, a guide, an arm, and a tong actuator (not shown). The tong may be transversely connected to the arm. The upper hinge may pivotally connect the arm to the handler body. The upper hinge may include a pair of knuckles fastened or welded to the handler body and a pin extending through the knuckles and a hole formed through a top of the arm. The tong may include a pair of semi-annular segments and the lower hinge may pivotally connect the segments to the arm. The tong actuator may include a pair of piston and cylinder assemblies each having an end pivotally connected to the arm and another end pivotally connected to the respective tong segment. The piston may divide the cylinder bore into an activation chamber and a stowing chamber and the cylinder may have ports formed through a wall thereof and each port may be in fluid communication with a respective chamber. Each port may be in fluid communication with the HPU manifold 27*m* via a respective control line 28*c* (FIG. 2). Supply of hydraulic fluid to the activation port may pivot the tong segments about the lower hinge toward an engaged position with the drill string 2. Supply of hydraulic fluid to the stowing port may pivot the tong segments about the lower hinge toward the stowed position adjacent to the rail 4*r*. The stowed position may accommodate connection and removal of the units 4*d,c,s* to/from the latch head 30. When not handling a drill pipe, the backup wrench 4*w* may be opened, as shown in FIG. 3A, to avoid collision with other tools, such as the casing tool 4*c*. Alternatively, the backup wrench 4*w* may be tilted and/or rotated to avoid collision.

Each tong segment may include a housing and a jaw (not shown) and the jaws may engage an outer surface of the drill string 2 when the tong segments are in the engaged position. The guide may be a pair of cone segments connected to a lower end of the tong housings, such as by fastening, for receiving a threaded coupling, such as a box, of the drill string 2. The thread saver 32 may extend into the tong opening for stabbing into the drill pipe box. Once stabbed, the tong actuator may be operated to engage the drill pipe box, thereby torsionally connecting the drill pipe box to the drive body 22. The motor unit 4*m* may then be operated to rotate the thread saver 32 relative to the drill pipe box, thereby connecting the drilling unit 4*d* to the drill string 2.

Figure 3B:
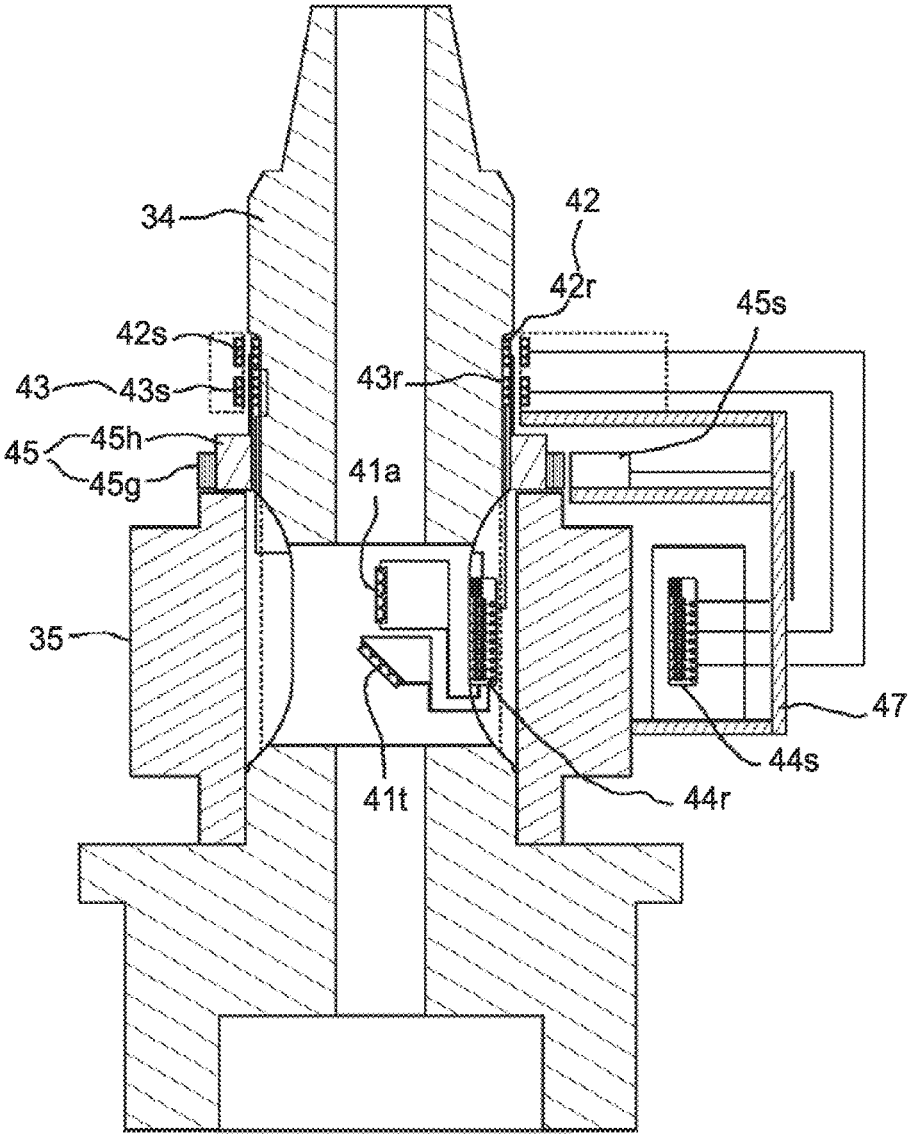
FIG. 3B illustrates a torque sub of a modular connection system of the top drive.

FIG. 3B illustrates a torque sub of the MCS 4*y*. The latch head 30 may include a torque shaft 34, a control swivel 35, a housing 36 (FIG. 4A), a seal sleeve 37 (FIG. 4A), a fastener assembly 38 (FIG. 4A), a cam 39 (FIG. 4A), an actuator 40 (FIG. 4A), and the torque sub. The torque sub may include a recess of the torque shaft 34, one or more load cells 41*a,t*, one or more wireless couplings, such as a wireless power coupling 42 and a wireless data coupling 43, a shaft electronics package 44*r*, a turns counter 45, a non-rotating interface box 47, and an interface electronics package 44*s*. The interface may be connected to a non-rotating outer barrel of the control swivel 35, such as by fastening.

The torque shaft 34 may be tubular, may have a bore formed therethrough, and may have couplings, such as a threaded box or pin, formed at each end thereof. The quill 23*q* may have a coupling, such as a threaded box or pin, formed at a lower end thereof and an upper end of the torque shaft 34 may be longitudinally and torsionally connected to the lower end of the quill 23*q*, such as by mating of the threaded couplings. The recess may be formed in an outer surface of the torque shaft 34. The load cell 41*t* may include a circuit of one or more torsional strain gages and the load cell 41*a* may include a circuit of one or more longitudinal strain gages, each strain gage attached to the recess of the torque shaft 34, such as by adhesive. The strain gages may each be made from metallic foil, semiconductor, or optical fiber.

Additionally, the load cell 41*a* may include a set of strain gages disposed around the torque shaft 34 such that one or more bending moments exerted on the torque shaft may be determined from the strain gage measurements. Alternatively, the torque shaft 34 may be a load shaft and the turns counter 45 and torsional strain gages may be omitted therefrom.

Each wireless coupling 42, 43 may include a shaft member 42*r*, 43*r* connected to the torque shaft 34 and an interface member 42*s*, 43*s* housed in an encapsulation on the interface box 47. The wireless power coupling members 42*r,s* may each be inductive coils and the wireless data coupling members 43*r,s* may each be antennas. The shaft electronics may be connected by leads and the electronics package 44*r*, load cells 41*a,t*, and the shaft member 43*r* may be encapsulated into the recess.

Alternatively, the torque shaft 34 may carry a power source, such as a battery, capacitor, and/or inductor, and the wireless power coupling 42 may be omitted or used only to charge the power source.

The shaft electronics package 44*r* may include a microcontroller, a power converter, an ammeter and a transmitter. The power converter may receive an AC power signal from the power coupling 42*r* and convert the signal to a DC power signal for operation of the shaft electronics. The DC power signal may be supplied to the load cells 41*a,t* and the ammeter may measure the current. The microcontroller may receive the measurements from the ammeter and digitally encode the measurements. The transmitter may receive the digitally encoded measurements, modulate them onto a carrier signal, and supply the modulated signal to the shaft member 43*r*.

The interface electronics package 44*s* may be housed in the interface box 47. The interface member 43*s* may receive the modulated signal and the interface electronics package 44*s* may include a receiver for demodulating the signal. The interface electronics package 44*s* may further include a microcontroller for digitally decoding the measurements and converting the measurements to torque and longitudinal load. The interface electronics package 44*s* may send the converted measurements to the control console 29 via a data cable 26*b* (FIG. 2). The interface package 44*s* may further include a power converter for supplying the interface data coupling with the AC power signal. The interface electronics package 44*s* may also be powered by the data cable 26*b* or include a battery.

The turns counter 45 may include a base 45*h* torsionally connected to the torque shaft 34, a turns gear 45*g* connected to the base, and a proximity sensor 45*s* housed in the interface box 47 and located adjacent to the turns gear. The turns gear 45*g* may be made from an electrically conductive metal or alloy and the proximity sensor 45*s* may be inductive. The proximity sensor 45*s* may include a transmitting coil, a receiving coil, an inverter for powering the transmitting coil, and a detector circuit connected to the receiving coil. A magnetic field generated by the transmitting coil may induce an eddy current in the turns gear 45*g*. The magnetic field generated by the eddy current may be measured by the detector circuit and supplied to the interface microcontroller. The interface microcontroller may then convert the measurement to angular movement and/or speed and supply the converted measurement to the control console 29.

Alternatively, the proximity sensor 45*s* may be Hall effect, ultrasonic, or optical. Alternatively, the turns counter 45 may include a gear box instead of a single turns gear 45*g* to improve resolution.

The control swivel 35 may include a rotating inner barrel and the non-rotating outer barrel. The inner barrel may be disposed around and connected to the torque shaft 34 and the outer barrel may be supported from the inner barrel by one or more bearings. The control swivel 35 may further include a torsional arrestor (not shown), such as a bracket, connected to the outer barrel and engaged with the rail 4*r*. The outer barrel may have hydraulic ports (not shown) formed through a wall thereof, each port in fluid communication with a respective hydraulic passage (not shown) formed through the inner barrel. An interface between each port and passage may be straddled by dynamic seals (not shown) for isolation thereof. The outer barrel ports may be in fluid communication with the HPU manifold 27*m* via control lines 28*b* (FIG. 2, only one shown) and the inner barrel passages may be in fluid communication with a control, such as hydraulic, junction 46 (FIG. 4B) via control lines 28*d,e* (FIG. 2). The outer barrel ports may be disposed along the outer barrel. The inner barrel may have a housing portion extending along the outer barrel and a foot portion extending below the outer barrel. The foot portion may connect to the torque shaft 34 and have the hydraulic ports extending therearound.

Figures 4A, 4B:
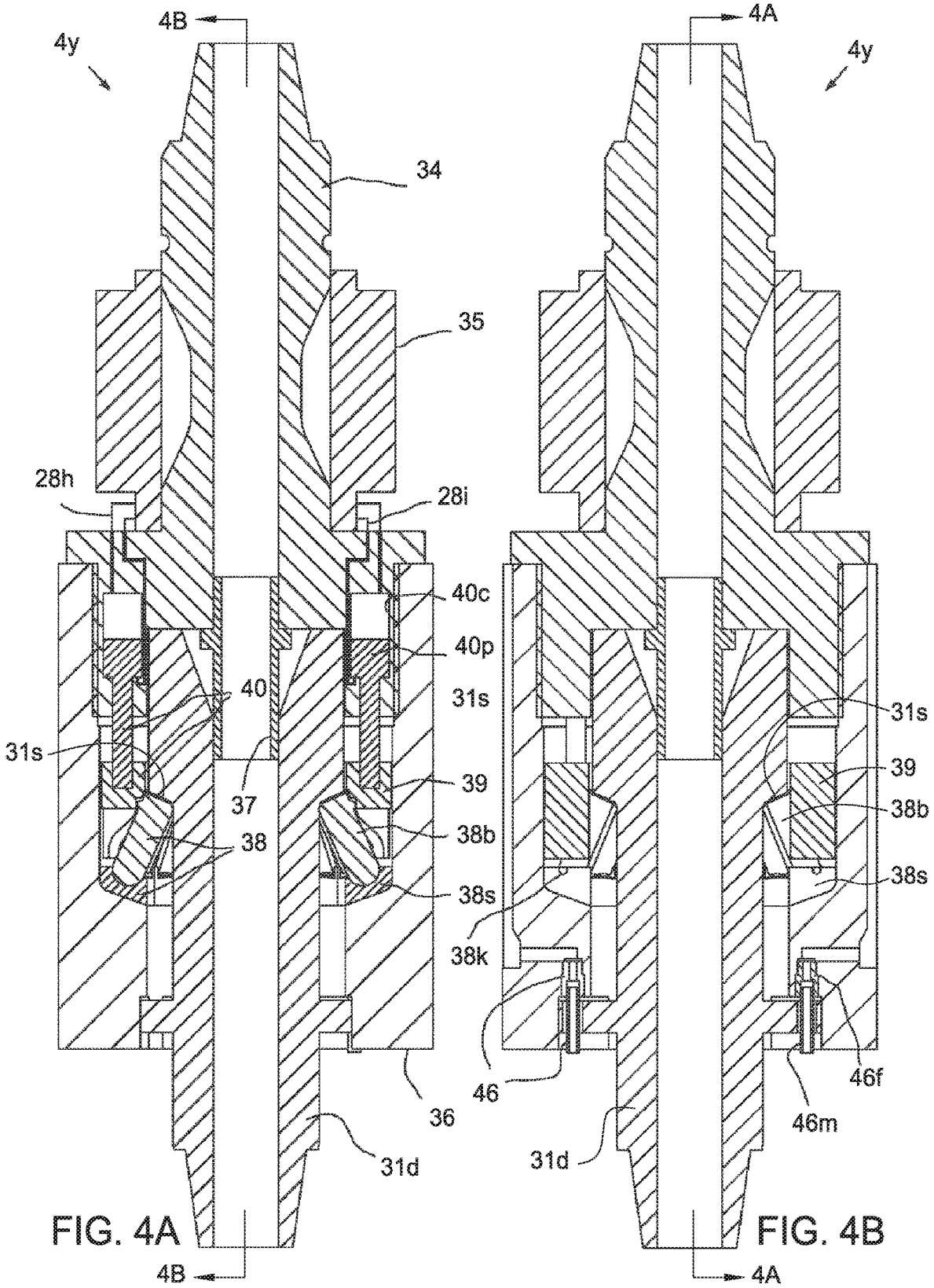
FIGS. 4A, 4B, and 5A illustrate the modular connection system in a docked mode.
Figure 5A:
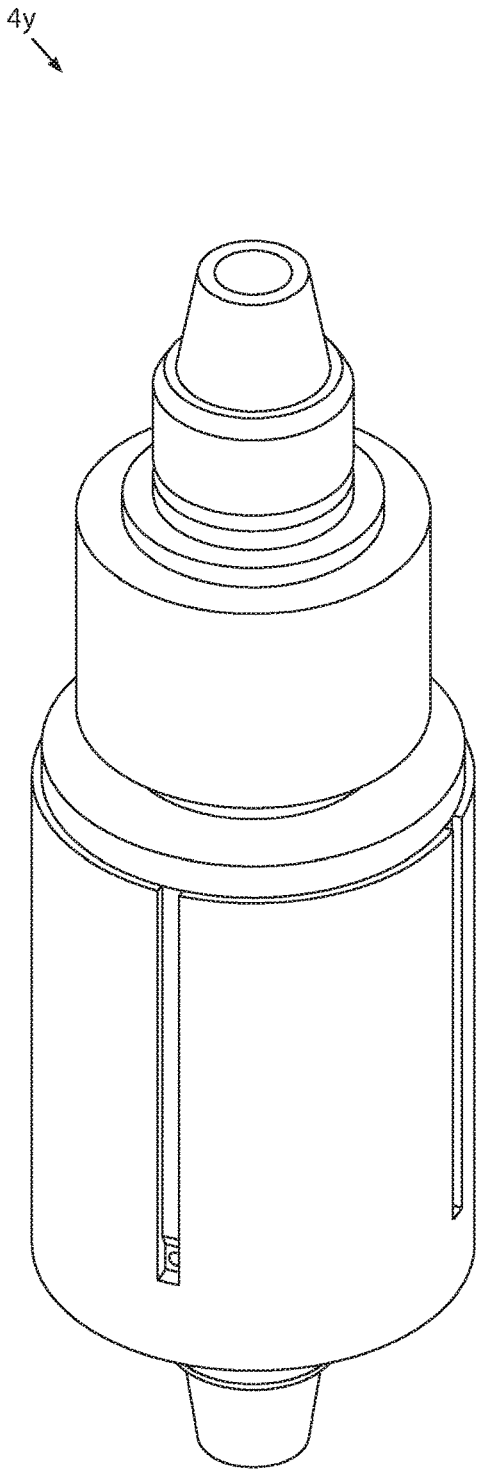

FIGS. 4A, 4B, and 5A illustrate the MCS 4*y* in a docked mode. The housing 36 may be tubular, may have a coupling, such as a threaded box or pin, formed at an upper end thereof, may have a shoulder formed in an inner surface thereof, and may have a torsional profile formed in an inner surface thereof and adjacent to a bottom thereof. An upper end of the housing 36 may be longitudinally and torsionally connected to the lower end of the torque shaft 34, such as by mating of the threaded couplings. The fastener assembly 38 may include a plurality of latch blocks 38*b* and a socket member 38*s*. In one embodiment, socket member may be a plurality of socket segment corresponding to the plurality of latch blocks 38*b*. The socket segments 38*s* may be arcuate, may form a ring when assembled, may be disposed in a bore of the housing 36, and may seat against the shoulder thereof. The shoulder of the housing 36 may be conical and lower faces of the socket segments 38*s* may have a shape conforming thereto. Each socket segment 38*s* may have an upper rounded face for receiving a lower rounded face of the respective latch block 38*b*, thereby forming an articulating joint therebetween.

Additionally, each latch block 38*b* may have a pin extending from each side thereof and the respective socket segment 38*s* may have knuckle segments formed in sides thereof for receiving the pins. Once the pins are inserted into the respective knuckle segments, additional knuckle segments may be fastened to the socket segments 38*s*, thereby trapping the pins therein. Additionally, the fastener assembly 38 may further include safety links 38*k*, such as cables, connected to the latch blocks 38*b* and the cam 39. The safety links 38*k* may not obstruct normal operation of the latch blocks 38*b* but may prevent dropping of the latch blocks in response to failure of the fastener assembly 38. Additionally, each socket segment 38*s* may be connected to the housing 36, such as by fastening.

Alternatively, the socket member 38*s* may be a socket ring.

The cam 39 may be a ring, may be disposed in the bore of the housing 36, and may be longitudinally movable relative thereto between an upper position (FIGS. 6A and 6B) and a lower position (shown). The cam 39 may have a notch formed through a wall thereof for each latch block 38*b* and each notch may extend from a lower end thereof for receiving the respective latch block. Walls of the cam 39 adjacent the notches may have actuation grooves formed therein and each latch block 38*b* may have a tongue formed in an outer surface thereof, located adjacent to an upper face thereof, and protruding from each lateral face thereof into adjacent actuation grooves. The actuation grooves may be wave-shaped to pivot the latch blocks 38*b* about the socket segments 38*s* between an extended position (shown) and a retracted position (FIGS. 6A and 6B) in response to movement of the cam 39 between the upper and lower positions. At a closed position, there is a contact surface between cam 39 and the latch blocks 38*b*. The contact surface is along the axial direction so that forces acting radial at the latch blocks 38*b* do not push the latch blocks 38*b* against the cam 39. Therefore, at the closed position, the latch blocks 38*b* may be locked by the cam 39 without loading the actuator 40.

Alternatively, the latch blocks 38*b* may have the actuation grooves formed in the lateral faces thereof and the cam may be a follower having the tongues formed therein adjacent to the notches.

The actuator 40 may be linear and may include one or more (pair shown) pistons 40*p* and chambers 40*c*. Each chamber 40*c* may be formed in a lower portion of the torque shaft 34 and each piston 40*p* may be disposed in the respective chamber. Each piston 40*p* may divide the respective chamber 40*c* into a raising portion and a lowering portion and the torque shaft 34 may have passages formed through the wall thereof for the chamber portions. Each passage may be in fluid communication with the HPU manifold 27*m* via a respective control line 28*h,i*. The pistons 40*p* may share a raising control line and a lowering control line via a splitter (not shown). Each piston 40*p* may have a head disposed in the respective chamber 40*c* and a rod extending therefrom and through an opening formed in the torque shaft 34 adjacent to the respective chamber and leading out a bottom thereof. The rod of each piston 40*p* may be connected to the cam 39, such as by threaded couplings. Supply of hydraulic fluid to the raising passages may move the cam 39 to the upper position (FIGS. 6A and 6B), thereby retracting the latch blocks 38*b*. Supply of hydraulic fluid to the lowering passages may move the cam 39 to the lowering position (shown), thereby extending the latch blocks 38*b*.

Alternatively, the actuator 40 may be electric or pneumatic instead of hydraulic. Alternatively, the housing 36, the actuator 40, the cam 39, and the latch blocks 38*b* may be replaced by a modified housing, a modified actuator, a linkage, and modified latch blocks. The modified actuator may be linear and located at an exterior of the modified housing. The modified housing may have a window formed through a wall thereof for each block. The linkage may include a link arm pivotally connected to each modified latch block and extending through a respective window and a ring pivotally connected to the link arms and disposed around the modified housing. The modified actuator may be operable to move the ring along the outer surface of the modified housing, thereby moving the modified latch blocks between the extended and retracted positions.

A lower face of the torque shaft 34 may serve as a stop for each stem 31*d,c,s*. Each stem 31*d,c,s* may be a shaft, may have an inner conical guide formed adjacent to an upper end thereof, may have a polished receptacle formed adjacent to the conical guide, may have a bore formed therethrough, and may have one or more threaded couplings, such as a pin and/or box, formed at a lower end thereof. Each stem 31*d,c,s* may further have a shoulder 31*sh* formed in an outer surface thereof and located therealong such that when a top thereof is engaged with the lower face of the torque shaft 34, the shoulder 31*sh* may be aligned with the latch blocks 38*b*. The shoulder 31*sh* of each stem 31*d,c,s* may be inclined relative to a transverse axis of the respective stem and a top of the latch blocks 38*b* may be contoured to mate with the respective shoulder 31*sh* in the extended position, thereby longitudinally connecting the respective unit 4*c,d,s* to the motor unit 4*m*.

The seal sleeve 37 may have an upper threaded portion (thread not shown), a lower stinger portion, and a shoulder connecting the portions. The upper threaded portion of the seal sleeve 37 may carry a seal (not shown) for engagement with a seal bore of the torque shaft 34 upon engagement of the upper threaded portion with an inner thread formed adjacent to the lower face of the torque shaft. A lower end of the stinger portion of the seal sleeve 37 may carry a stab seal (not shown) for engagement with an inner seal receptacle of each stem 31*c,d,s* when the respective unit 4*d,c,s* is connected to the motor unit 4*m*, thereby sealing an interface formed between the units.

The housing 36 may have one or more control passages, such as slots, formed in and along an outer surface thereof for routing of the respective control lines 28*d,e* from the control swivel 35 to the control junction 46. The control slots may extend from a top of the housing 36 to respective control ports formed therein. Each control port may have a coupling for connection to a lower end of the respective control line 28*d,e*. Each control port may lead to a respective socket formed in the housing 36 adjacent to the torsional profile thereof. Each socket may be threaded for receiving a respective female member 46*f* of the control junction 46 and have a seal bore for receiving a seal (not shown) carried thereby. The male members 46*m* of the control junction 46 may each have a nipple portion for receiving a respective control line 28*f,g*, and a stinger portion carrying a seal (not shown). Each female member 46*f* may have a seal receptacle for receiving the respective stinger.

Alternatively, the control passages may be formed in and along a wall of the housing 36 instead of being slots formed in the outer surface thereof. Alternatively, the control passages may be omitted from the housing 36 and the respective control lines 28*d,e* may be routed along an outer surface thereof and be protected by a shroud connected to the housing.

Each stem 31*d,c,s* may further have a torsional coupling formed in an outer surface thereof. Each torsional coupling of the respective stem 31*d,c,s* may have a polygonal shape, such as square, and the torsional profile of the housing 36 may have a complementary polygonal shape for mating therewith, thereby torsionally connecting the respective unit 4*c,d,s* to the motor unit 4*m* upon insertion of the respective stem into the housing. The male members 46*m* may be connected to the torsional coupling of each stem 31*d,c,s*, such as being arranged at corners thereof, and the female members 46*f* may be arranged adjacent to corners of the torsional profile of the housing 36 such that the male members may be stabbed into the female members as the respective stem is inserted into the housing 36, thereby connecting the control junction 46. The torsional profile of the housing 36 may be oversized relative to the torsional coupling of each stem 31*d,c,s* to allow limited longitudinal movement therebetween.

Alternatively, the torsional coupling of each stem 31*d,c,s* may be a separate piece attached to an outer surface thereof, such as by welding. Alternatively, the torsional coupling may be formed in an inner surface of each stem 31*d,c,s* and the torsional profile may be formed on an outer surface of the housing 36. Alternatively, each unit 4*c,d,s* may include the housing 36 and associated seal sleeve 37, fastener assembly 38, cam 39, and actuator 40 and the latch head 30 may include one of the stems 31*d,c,s* connected to or formed in a lower end of the torque shaft 34. Alternatively, each unit 31*d,c,s* may have the HPU manifold 27*m*. Alternatively, the male 46*m* and female 46*f* members may be positioned at another location on the respective latch head 30 and stems 31*d,c,s*.

Figure 5B:
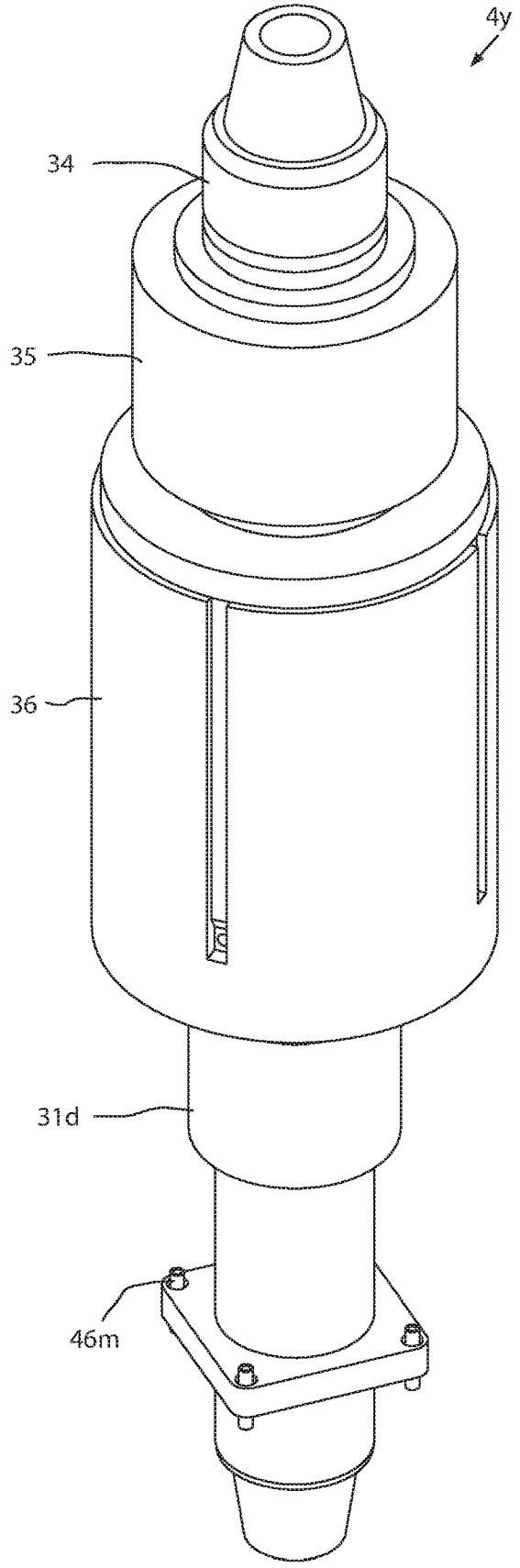
FIGS. 5B, 6A, and 6B illustrate the modular connection system in a release mode.
Figure 6A:
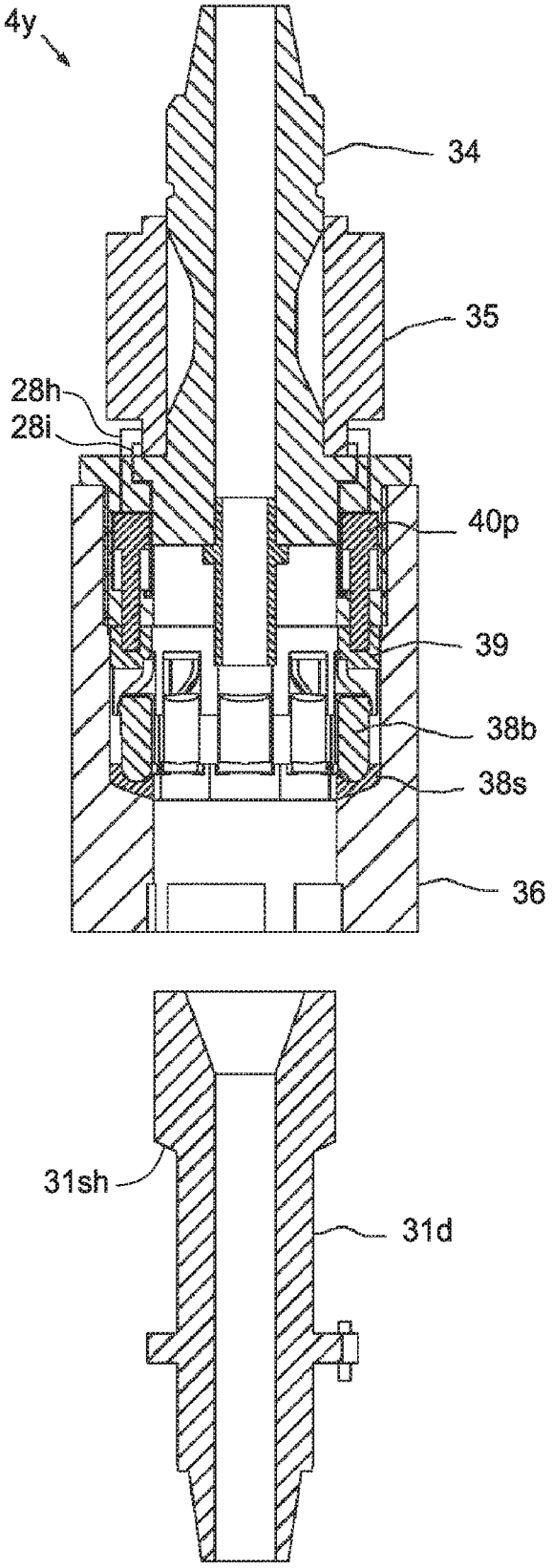
Figure 6B:
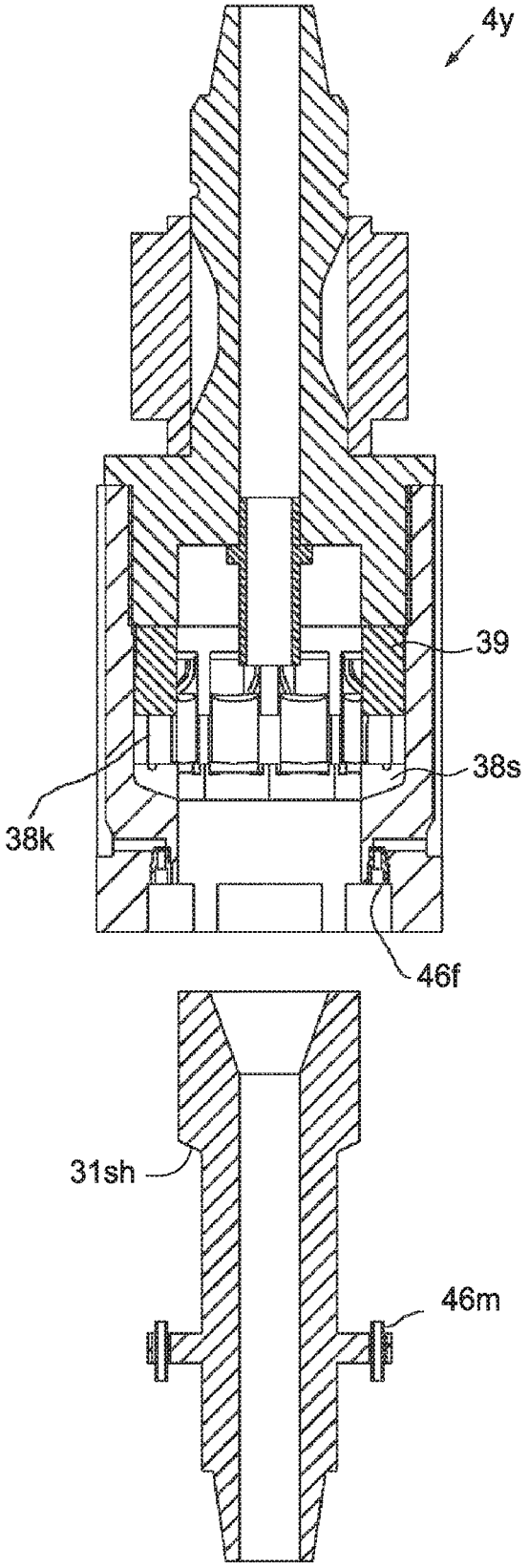

FIGS. 5B, 6A, and 6B illustrate the modular connection system 4*y* in a release mode. During drilling of the wellbore 9, once a top of the drill string 2 reaches the rig floor 3*f*, the drill string must be extended to continue drilling. Drilling may be halted by stopping rotation 6*r* of the motor unit 4*m*, stopping lowering 6*a* of the traveling block 5*t*, stopping injection of the drilling fluid 13*d*, and removing weight from the drill bit 2*b*. A spider 48 (FIG. 1) may then be installed into a rotary table 49 (FIG. 1), thereby longitudinally supporting the drill string 2 from the rig floor 3*f*. The tong actuator of the backup wrench 4*w* may be operated via control line 28*c* to engage the backup wrench tong with a top coupling of the drill string 2. The drive motors 18 may then be operated to loosen and counter-spin the connection between the thread saver and the top coupling of the drill string 2. The pipe handler 4*p* may then be raised by the hoist 5 until the drill pipe elevator is adjacent a top of a stand of drill pipe to be added to the drill string 2. The elevator may be engaged with the stand, the hoist 5 operated to lift the stand from a pipe rack of the drilling rig, and the link tilt operated to swing the stand from the pipe rack to a location adjacent a top of the drill string. A set of tongs may be used to screw the stand into the top of the drill string. The top drive 4 may then be lowered by the hoist 5 until the thread saver 32 is adjacent to a top of the stand. The backup wrench may then be engaged with the top of the stand and the drive motors 18 operated to spin and tighten the connection between the thread saver 32 and the top coupling of the stand. The spider 48 may then be released and drilling may continue.

Once drilling the lower formation 10*b* has been completed, the drill string 2 may be tripped out from the wellbore 9. Once the drill string 2 has been retrieved to the rig 1*r*, the backup wrench 4*w* may be shifted to the stowed position and the drilling unit 4*d* may be released from the motor unit 4*m* by operation of the actuator 40. The drilling elevator may be removed from the pipe handler 4*p* and the link tilt operated to move the bails to a stowed position.

Figure 7A:
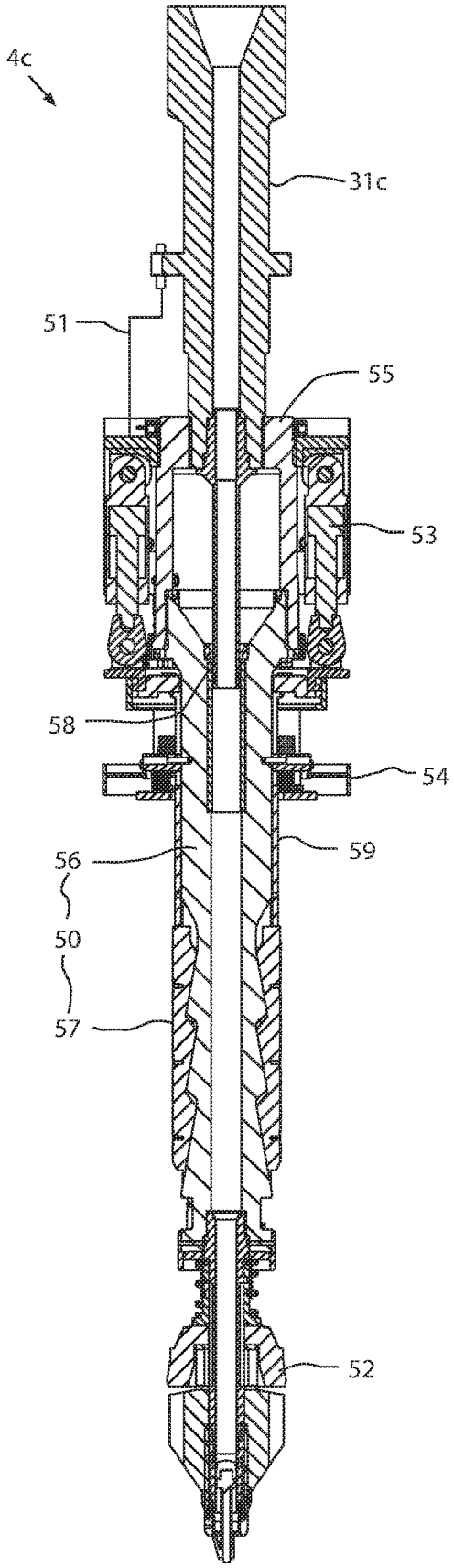
FIG. 7A illustrates a casing unit of the top drive.
Figure 7B:
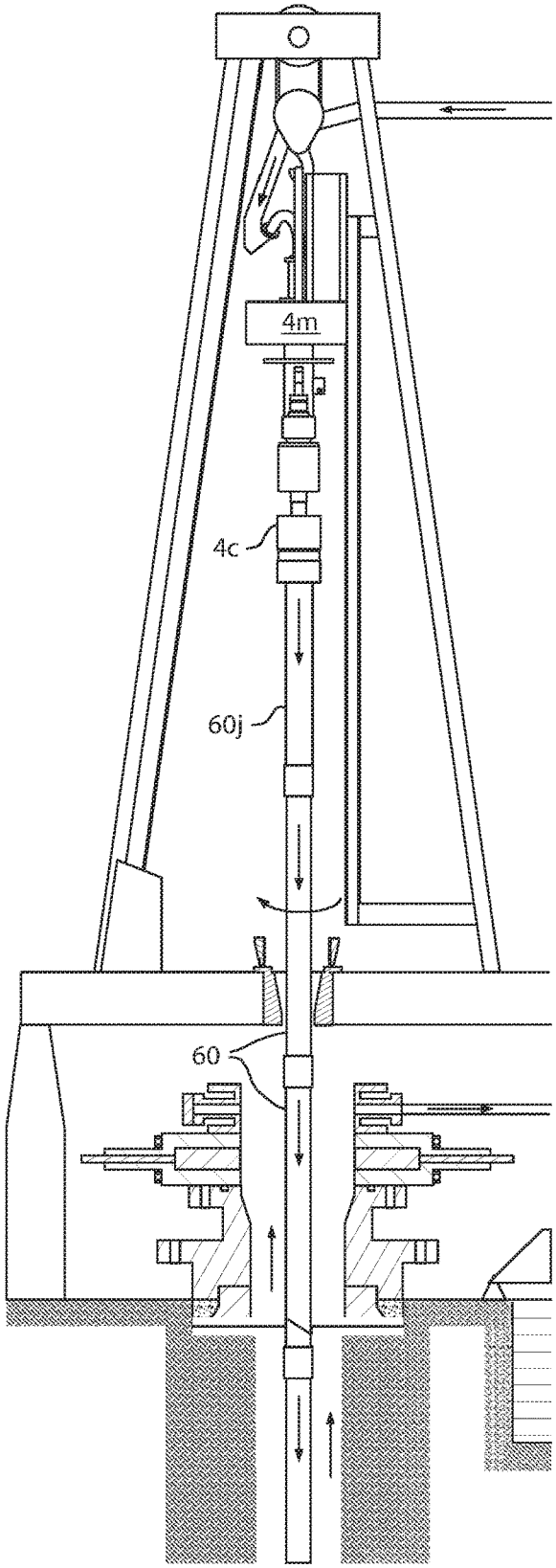
FIG. 7B illustrates the drilling system in a casing mode.

FIG. 7A illustrates the casing unit 4*c*. The casing unit 4*c* may include the casing stem 31*c*, a clamp, such as a spear 50, one or more control lines 51, and a fill up tool 52. The spear 50 may be capable of supporting weight of a casing string 60 (FIG. 7B). The spear 50 may include a linear actuator 53, a bumper 54, a collar 55, a housing 56, a set of grippers, such as slips 57, a seal joint 58, and a sleeve 59. The collar 55 may have an inner thread formed at each longitudinal end thereof. The collar upper thread may be engaged with an outer thread of the stem 31*c*, thereby connecting the two members. The collar lower thread may be engaged with an outer thread formed at an upper end of the housing 56 and the housing may have an outer flange formed adjacent to the upper thread and engaged with a bottom of the collar 55, thereby connecting the two members.

The seal joint 58 may include an inner barrel, an outer barrel, and a nut. The inner barrel may have an outer thread engaged with a threaded portion of the casing stem 31*c* and an outer portion carrying a seal engaged with a seal bore portion of the casing stem. The housing 56 may have a bore formed therethrough and an inner receptacle formed at an upper portion thereof and in communication with the bore. The housing receptacle may have an upper conical portion, a threaded mid portion, and a recessed lower portion. The outer barrel may be disposed in the recessed portion of the housing 56 and trapped therein by engagement of an outer thread of the nut with the threaded mid portion of the housing receptacle. The outer barrel may have a seal bore formed therethrough and a lower portion of the inner barrel may be disposed therein and carry a stab seal engaged therewith.

The linear actuator 53 may include a housing, an upper flange, a plurality of piston and cylinder assemblies, and a lower flange. The housing may be cylindrical, may enclose the cylinders of the assemblies, and may be connected to the upper flange, such as by fastening. The collar 55 may also have an outer thread formed at the upper end thereof. The upper flange may have an inner thread engaged with the outer collar thread, thereby connecting the two members. Each flange may have a pair of lugs for each piston and cylinder assembly connected, such as by fastening or welding, thereto and extending from opposed surfaces thereof.

Each cylinder of the linear actuator 53 may have a coupling, such as a hinge knuckle, formed at an upper end thereof. The upper hinge knuckle of each cylinder may be received by a respective pair of lugs of the upper flange and pivotally connected thereto, such as by fastening. Each piston of the linear actuator 53 may have a coupling, such as a hinge knuckle, formed at a lower end thereof. Each piston of the linear actuator 53 may be disposed in a bore of the respective cylinder. The piston may divide the cylinder bore into a raising chamber and a lowering chamber and the cylinder may have ports formed through a wall thereof and each port may be in fluid communication with a respective chamber.

Each port may be in fluid communication with the HPU manifold 27*m* via a respective control line 51, the control junction 46, a respective one of the control lines 28*d,e*, the control swivel 35, and a respective one of the control lines 28*b*. Supply of hydraulic fluid to the raising port may lift the lower flange to a retracted position (shown). Supply of hydraulic fluid to the lowering port may drop the lower flange toward an extended position (not shown). The piston and cylinder assemblies may share an extension control line and a retraction control line via a splitter (not shown).

The sleeve 59 may have an outer shoulder formed in an upper end thereof trapped between upper and lower retainers. A washer may have an inner shoulder formed in a lower end thereof engaged with a bottom of the lower retainer. The washer may be connected to the lower flange, such as by fastening, thereby longitudinally connecting the sleeve 59 to the linear actuator 53. The sleeve 59 may also have one or more (pair shown) slots formed through a wall thereof at an upper portion thereof. The bumper 54 may be connected to the housing 56, such as by one or more threaded fasteners, each fastener extending through a hole thereof, through a respective slot of the sleeve 59, and into a respective threaded socket formed in an outer surface of the housing, thereby also torsionally connecting the sleeve to the housing while allowing limited longitudinal movement of the sleeve relative to the housing to accommodate operation of the slips 57. A lower portion of the spear 50 may be stabbed into a casing joint 60*j* (FIG. 7B) until the bumper 54 engages a top of the casing joint. The bumper 54 may cushion impact with the top of the casing joint 60*j* to avoid damage thereto.

The sleeve 59 may extend along the outer surface of the housing from the lower flange of the linear actuator 53 to the slips 57. A lower end of the sleeve 59 may be connected to upper portions of each of the slips 57, such as by a flanged (i.e., T-flange and T-slot) connection. Each slip 57 may be radially movable between an extended position and a retracted position by longitudinal movement of the sleeve 59 relative to the slips. A slip receptacle may be formed in an outer surface of the housing 56 for receiving the slips 57. The slip receptacle may include a pocket for each slip 57, each pocket receiving a lower portion of the respective slip. The housing 56 may be connected to lower portions of the slips 57 by reception thereof in the pockets. Each slip pocket may have one or more (three shown) inclined surfaces formed in the outer surface of the housing 56 for extension of the respective slip. A lower portion of each slip 57 may have one or more (three shown) inclined inner surfaces corresponding to the inclined slip pocket surfaces.

Downward movement of the sleeve 59 toward the slips 57 may push the slips along the inclined surfaces, thereby wedging the slips toward the extended position. The lower portion of each slip 57 may also have a guide profile, such as tabs, extending from sides thereof. Each slip pocket may also have a mating guide profile, such as grooves, for retracting the slips 57 when the sleeve 59 moves upward away from the slips. Each slip 57 may have teeth formed along an outer surface thereof. The teeth may be made from a hard material, such as tool steel, ceramic, or cermet for engaging and penetrating an inner surface of the casing joint 60*j*, thereby anchoring the spear 50 to the casing joint.

The fill up tool 52 may include a flow tube, a stab seal, such as a cup seal, a release valve, and a mud saver valve. The cup seal may have an outer diameter slightly greater than an inner diameter of the casing joint to engage the inner surface thereof during stabbing of the spear 50 therein. The cup seal may be directional and oriented such that pressure in the casing bore energizes the seal into engagement with the casing joint inner surface. An upper end of the flow tube may be connected to a lower end of the housing 56, such as by threaded couplings. The mud saver valve may be connected to a lower end of the flow tube, such as by threaded couplings. The cup seal and release valve may be disposed along the flow tube and trapped between a bottom of the housing and a top of the mudsaver valve.

Alternatively, the clamp may be a torque head instead of the spear 50. The torque head may be similar to the spear except for receiving an upper portion of the casing joint 60*j* therein and having the grippers for engaging an outer surface of the casing joint instead of the inner surface of the casing joint.

FIG. 7B illustrates the drilling system 1 in a casing mode. The casing unit 4*c* may be oriented relative to the housing 36 and inserted until a top of the casing stem 31*c* engages the lower face of the torque shaft 34. The actuator 40 may then be operated to engage the latch blocks 38*b* with the shoulder of the casing stem 31*c*. The spear 50 and fill up tool 52 may be stabbed into the casing string 60 until the bumper 54 engages a top of the casing string. Injection of the drilling fluid 13*d* into the casing string 60 and rotation thereof by the drive motors 18 may allow the casing string to be reamed into the wellbore 9.

Figure 8A:
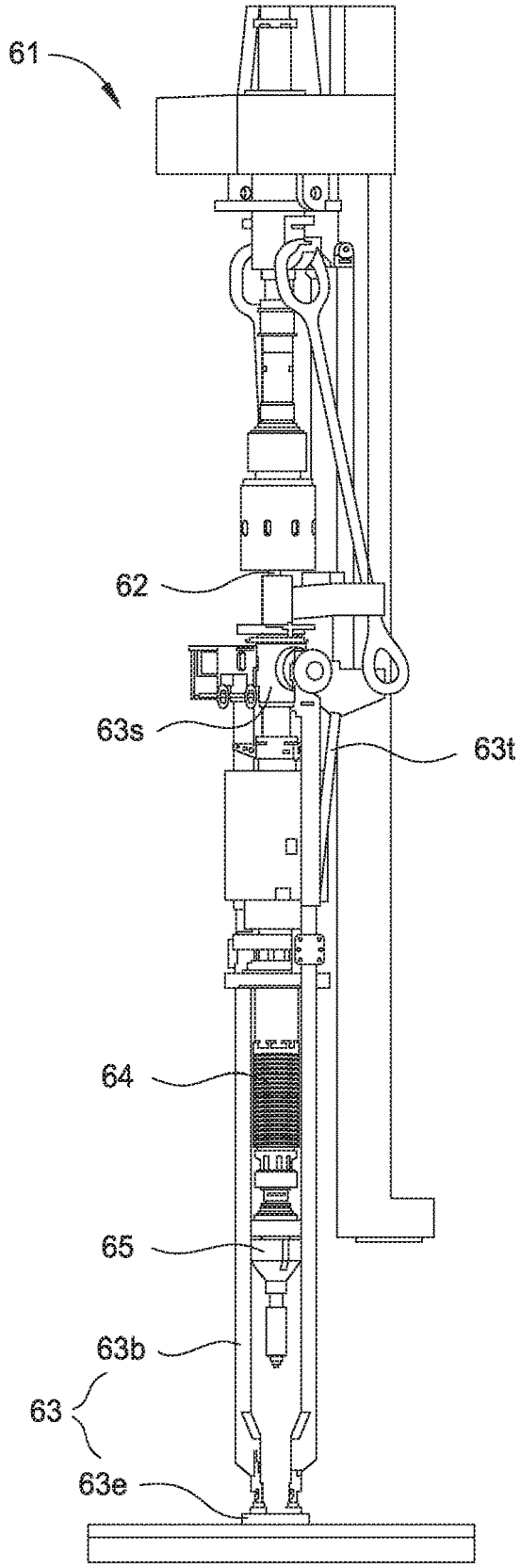
FIG. 8A illustrates an alternative casing unit connected to a motor unit of the top drive, according to another embodiment of the present invention.

FIG. 8A illustrates an alternative casing unit 61 connected to the motor unit 4*m*, according to another embodiment of the present invention. The alternative casing unit 61 may include an alternative casing stem 62, a casing handler 63, an alternative spear 64, and an alternative fill up tool 65. The alternative spear 64 may be similar to the spear 50 except that the seal joint 58 may be omitted therefrom and a housing thereof may connect directly to the alternative casing stem 62.

The casing handler 63 may include a swivel 63*s*, a casing elevator 63*e*, a pair of bails 63*b*, and a link tilt 63*t*. An inner barrel of the swivel 63*s* may be connected to the housing and an outer non-rotating barrel of the swivel may be supported therefrom by bearings. Each bail 63*b* may have an eyelet formed at each longitudinal end thereof. An upper eyelet of each bail may be received by a respective knuckle of the swivel 63*s*. The link tilt 63*t* may include a pair of piston and cylinder assemblies for swinging the casing elevator 63*e* relative to the handler body. Each piston and cylinder assembly may have a coupling, such as a hinge knuckle, formed at each longitudinal end thereof. An upper hinge knuckle of each piston and cylinder assembly may be received by a respective lifting lug of the swivel 63*s* and pivotally connected thereto, such as by fastening. A lower hinge knuckle of each piston and cylinder assembly may be received by a complementary hinge knuckle of the respective bail and pivotally connected thereto, such as by fastening. A piston of each piston and cylinder assembly may be disposed in a bore of the respective cylinder. The piston may divide the cylinder bore into a raising chamber and a lowering chamber and the cylinder may have ports formed through a wall thereof and each port may be in fluid communication with a respective chamber.

Each port may be in fluid communication with the manifold 27*m* via a respective control line (not shown) connected to the outer barrel of the swivel 63*s* and another respective control line (not shown) connecting the inner barrel of the swivel to the male member 46*m* of the alternative casing stem 62. Supply of hydraulic fluid to the raising port may lift the casing elevator 63*e* by increasing a tilt angle (measured from a longitudinal axis of the rail 4*r*). Supply of hydraulic fluid to the lowering port may drop the casing elevator 63*e* by decreasing the tilt angle. The casing elevator 63*e* may be manually opened and closed or the casing handler 63 may include an actuator (not shown) for opening and closing the casing elevator. The casing elevator 63*e* may be similar to the drill pipe elevator except for being sized to handle the casing joint 60*j*. The casing handler 63 may deliver the casing joint 60*j* to the casing string 60 where the joint may be assembled therewith to extend the casing string during a casing operation.

During running of the casing string 60 into the wellbore 9, once a top of the casing string 60 reaches the rig floor 3*f*, the casing string must be extended to continue deployment. Deployment may be halted by stopping rotation 6*r* of the motor unit 4*m*, stopping lowering 6*a* of the traveling block 5*t*, and stopping injection of the drilling fluid 13*d*. The spider 48 may then be installed into the rotary table 49, thereby longitudinally supporting the casing string 60 from the rig floor 3*f*. The slips of the alternative spear 64 may be released from a top joint of the casing string 60 by operating a linear actuator of the alternative spear. The casing handler 63 may then be raised by the hoist 5 until the casing elevator 63*e* is adjacent a top of a casing joint 60*j* to be added to the casing string 60. The casing elevator 63*e* may be engaged with the casing joint 60*j*, the hoist 5 operated to lift the casing joint from the rig floor 3*f*, and the link tilt 63*t* operated to swing the casing joint from the rig floor to a location adjacent a top of the casing string 60. The top drive 4 may then be lowered to stab the casing joint 60*j* into the casing string and further lowered to stab the alternative spear 64 and alternative fill up tool 65 into the casing joint 60*j*. The spear slips may then be engaged with the casing joint 60*j* by operating a linear actuator of the alternative spear 64. The rotary table 49 may be locked or a backup tong (not shown) may be engaged with the top of the casing string 60 and the drive motors 18 may be operated to spin and tighten the threaded connection between the casing joint 60*j* and the casing string 60. The spider 48 may then be released and running of the extended casing string may continue.

Figure 8B:
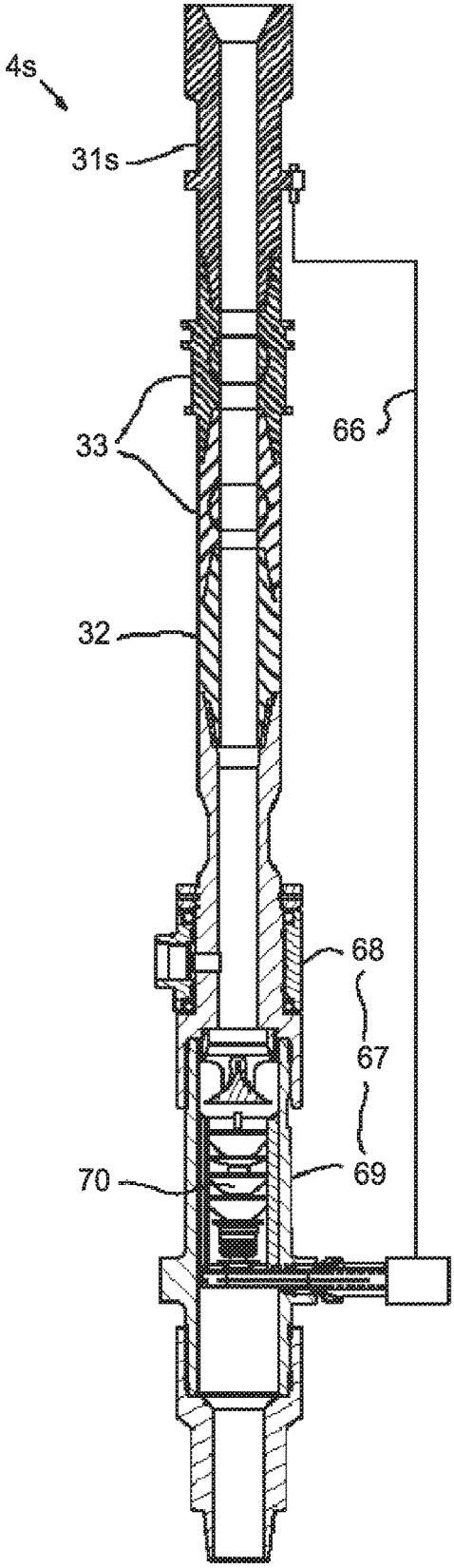
FIG. 8B illustrates a cementing unit of the top drive.

FIG. 8B illustrates the cementing unit 4*s*. The cementing unit 4*s* may include the cementing stem 31*s*, the thread saver 32, the IBOP 33, one or more control lines 66, and a cementing head 67. The cementing head 67 may include a cementing swivel 68, a launcher 69, and a release plug, such as a dart 70.

The cementing swivel 68 may include a housing torsionally connected to the drive body 22 or rail 4*r*, such as by a bar (not shown). The cementing swivel 68 may further include a housing and bearings for supporting the housing from the housing while accommodating rotation of the housing. An upper end of the housing may be connected to a lower end of the thread saver 32, such as by threaded couplings. The cementing swivel 68 may further include an inlet formed through a wall of the housing and in fluid communication with a port formed through the housing and a seal assembly for isolating the inlet-port communication. The housing port may provide fluid communication between a bore of the cementing head 67 and the housing inlet.

Figure 9:
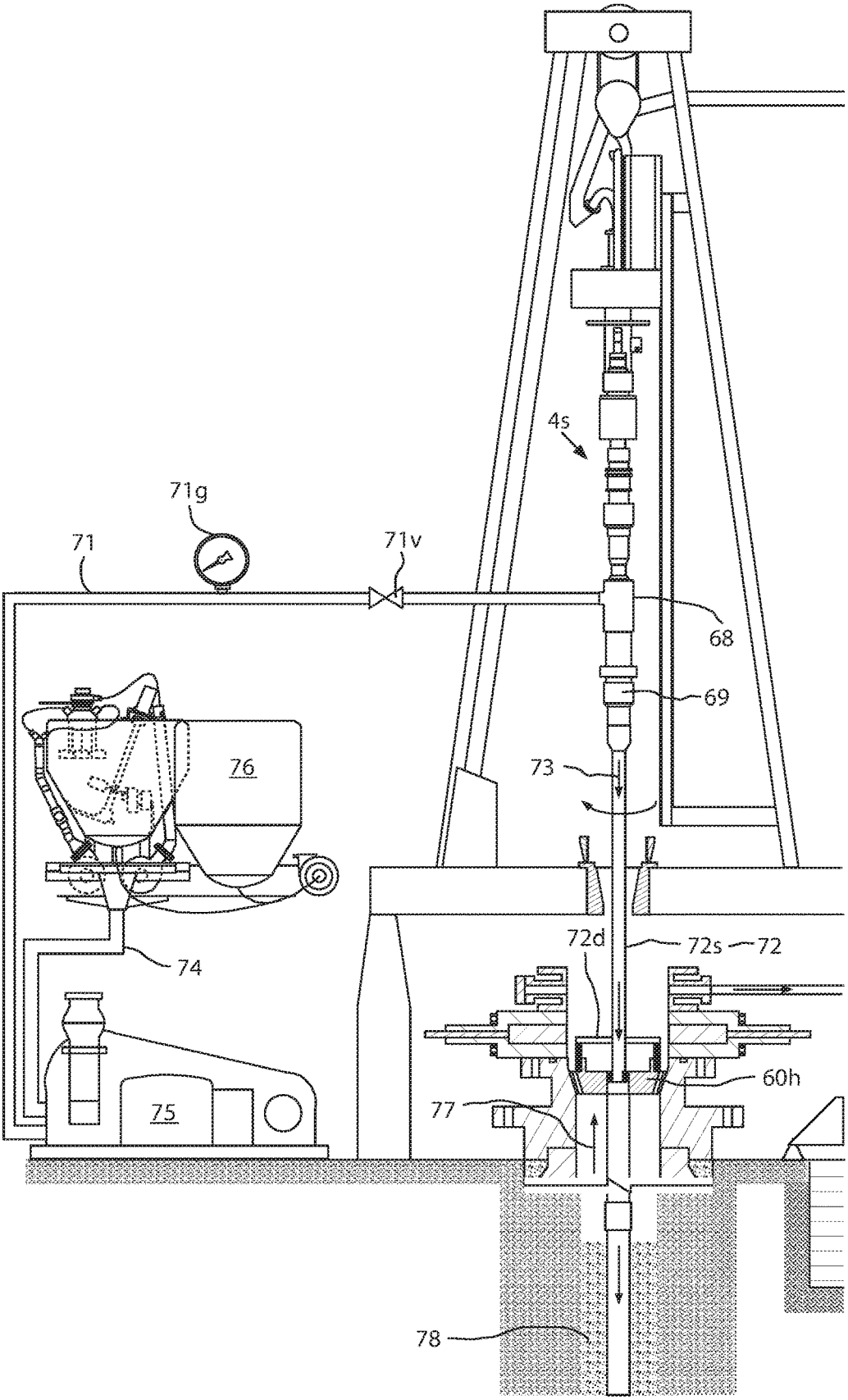
FIG. 9 illustrates the drilling system in a cementing mode.

The launcher 69 may include a body, a deflector, a canister, a gate, the actuator, and an adapter. The body may be tubular and may have a bore therethrough. An upper end of the body may be connected to a lower end of the cementing swivel 68, such as by threaded couplings, and a lower end of the body may be connected to the adapter, such as by threaded couplings. The canister and deflector may each be disposed in the body bore. The deflector may be connected to the cementing swivel housing, such as by threaded couplings. The canister may be longitudinally movable relative to the body. The canister may be tubular and have ribs formed along and around an outer surface thereof. Bypass passages (only one shown) may be formed between the ribs. The canister may further have a landing shoulder formed in a lower end thereof for receipt by a landing shoulder of the adapter. The deflector may be operable to divert fluid received from a cement line 71 (FIG. 9) away from a bore of the canister and toward the bypass passages. The adapter may have a threaded coupling, such as a threaded pin, formed at a lower end thereof for connection to a work string 72 (FIG. 9).

The dart 70 may be disposed in the canister bore. The dart 70 may be made from one or more drillable materials and include a finned seal and housing. The housing may be made from a metal or alloy and may have a landing shoulder and carry a landing seal for engagement with the seat and seal bore of a wiper plug (not shown) of the work string 72.

The gate of the launcher 69 may include a housing, a plunger, and a shaft. The housing may be connected to a respective lug formed in an outer surface of the body, such as by threaded couplings. The plunger may be radially movable relative to the body between a capture position and a release position. The plunger may be moved between the positions by a linkage, such as a jackscrew, with the shaft. The shaft may be connected to and rotatable relative to the housing. The actuator may be a hydraulic motor operable to rotate the shaft relative to the housing. The actuator may include a reservoir (not shown) for receiving the spent hydraulic fluid or the cementing head 67 may include a second actuator swivel and hydraulic conduit (not shown) for returning the spent hydraulic fluid to the HPU 27.

In operation, when it is desired to launch the dart 70, the console 29 may be operated to supply hydraulic fluid to the launcher actuator via the control line 66. The launcher actuator may then move the plunger to the release position. The canister and dart 70 may then move downward relative to the launcher body until the landing shoulders engage. Engagement of the landing shoulders may close the canister bypass passages, thereby forcing chaser fluid 73 (FIG. 9) to flow into the canister bore. The chaser fluid 73 may then propel the dart 70 from the canister bore, down a bore of the adapter, and onward through the work string 72.

Alternatively, the launcher actuator may be pneumatic or electric.

FIG. 9 illustrates the drilling system 1 in a cementing mode. As a shoe (not shown) of the casing string 60 nears a desired deployment depth of the casing string, such as adjacent a bottom of the lower formation 10*b*, a casing hanger 60*h* may be assembled with the casing string 60. Once the casing hanger 60*h* reaches the rig floor 3*f*, the spider 48 may be set.

The casing unit 4*c* may be released from the motor unit 4*m* and replaced by the cementing unit 4*s*. The work string 72 may be connected to the casing hanger 60*h* and the work string extended until the casing hanger 60*h* seats in the wellhead 7. The work string 72 may include a casing deployment assembly (CDA) 72*d* and a pipe string 72*s*, such as such as one or more joints of drill pipe connected together, such as by threaded couplings. An upper end of the CDA 72*d* may be connected a lower end of the pipe string 72*s*, such as by threaded couplings. The CDA 72*d* may be connected to the casing hanger 60*h*, such as by engagement of a bayonet lug (not shown) with a mating bayonet profile (not shown) formed the casing hanger. The CDA 72*d* may include a running tool, a plug release system (not shown), and a packoff. The plug release system may include an equalization valve and a wiper plug. The wiper plug may be releasably connected to the equalization valve, such as by a shearable fastener.

Once the cementing unit 4*s* has been connected to the motor unit 4*m*, an upper end of the cement line 71 may be connected to an inlet of the cementing swivel 68. A lower end of the cement line 71 may be connected to an outlet of a cement pump 75. A cement shutoff valve 71*v* and a cement pressure gauge 71*g* may be assembled as part of the cement line 71. An upper end of a cement feed line 74 may be connected to an outlet of a cement mixer 76 and a lower end of the cement feed line may be connected to an inlet of the cement pump 75.

Once the cement line 71 has been connected to the cementing swivel 68, the IBOP 33 may be closed and the drive motors 18 may be operated to rotate the work string 72 and casing string 60 during the cementing operation. The cement pump 75 may then be operated to inject conditioner 77 from the mixer 76 and down the casing string 60 via the feed line 74, the cement line 71, the cementing head 67, and a bore of the work string 72. Once the conditioner 77 has circulated through the wellbore 77, cement slurry 78 may be pumped from the mixer 76 into the cementing swivel 68 by the cement pump 75. The cement slurry 78 may flow into the launcher 69 and be diverted past the dart 70 (not shown) via the diverter and bypass passages. Once the desired quantity of cement slurry 78 has been pumped, the dart 70 may be released from the launcher 69 by operating the launcher actuator. The chaser fluid 73 may be pumped into the cementing swivel 68 by the cement pump 75. The chaser fluid 73 may flow into the launcher 69 and be forced behind the dart 70 by closing of the bypass passages, thereby launching the dart.

Pumping of the chaser fluid 73 by the cement pump 75 may continue until residual cement in the cement line 71 has been purged. Pumping of the chaser fluid 73 may then be transferred to the mud pump 12 by closing the valve 71*v* and opening the IBOP 33. The dart 70 and cement slurry 78 may be driven through the work string bore by the chaser fluid 73. The dart 70 may land onto the wiper plug and continued pumping of the chaser fluid 73 may increase pressure in the work string bore against the seated dart 70 until a release pressure is achieved, thereby fracturing the shearable fastener. Continued pumping of the chaser fluid 73 may drive the dart 70, wiper plug, and cement slurry 78 through the casing bore. The cement slurry 78 may flow through a float collar (not shown) and the shoe of the casing string 60, and upward into the annulus.

Pumping of the chaser fluid 73 may continue to drive the cement slurry 78 into the annulus until the wiper plug bumps the float collar. Pumping of the chaser fluid 73 may then be halted and rotation of the casing string 60 may also be halted. The float collar may close in response to halting of the pumping. The work string 72 may then be lowered to set a packer of the casing hanger 60*h*. The bayonet connection may be released and the work string 72 may be retrieved to the rig 1*r*.

Alternatively, for a liner operation (not shown) or a subsea casing operation, the drilling unit 4*d* may be used again after the casing or liner string is assembled for assembling a work string (not shown) used to deploy the assembled casing or liner string into the wellbore 9. The top drive 4 may be shifted back to the drilling mode for assembly of the work string. The work string may include a casing or liner deployment assembly and a string of drill pipe such that the drilling unit 4*d* may be employed to assemble the pipe string. The motor unit 4*m* may be operated for reaming the casing or liner string into the wellbore 9.

Other designs of modular connection systems may be used in place of the MCS 4*y* described above. FIGS. 10-14 describe alternative designs of modular connection system according to embodiments of the present disclosure.

Figure 10C:
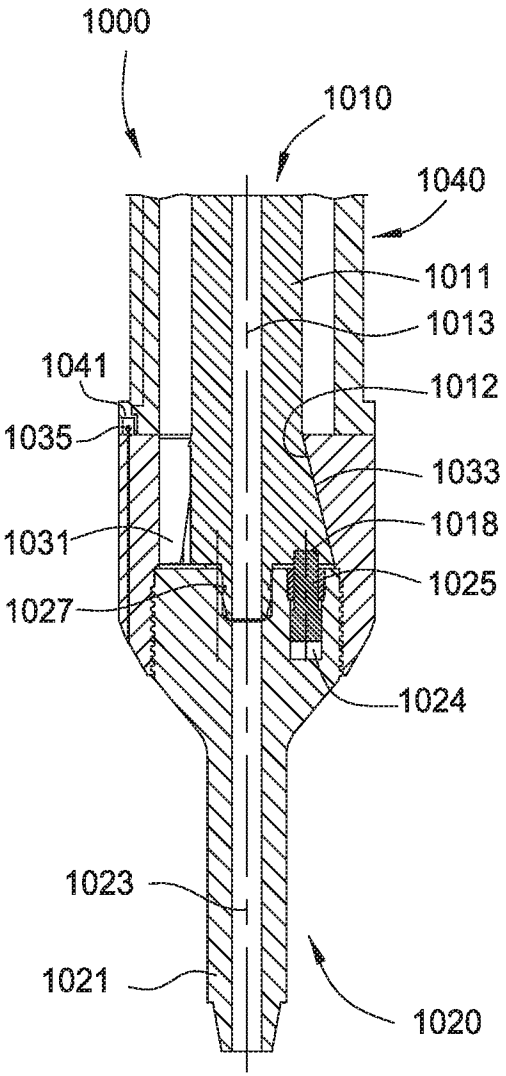
FIGS. 10A-10C illustrates a modular connection system according to one embodiment of the present disclosure.
Figure 10B:
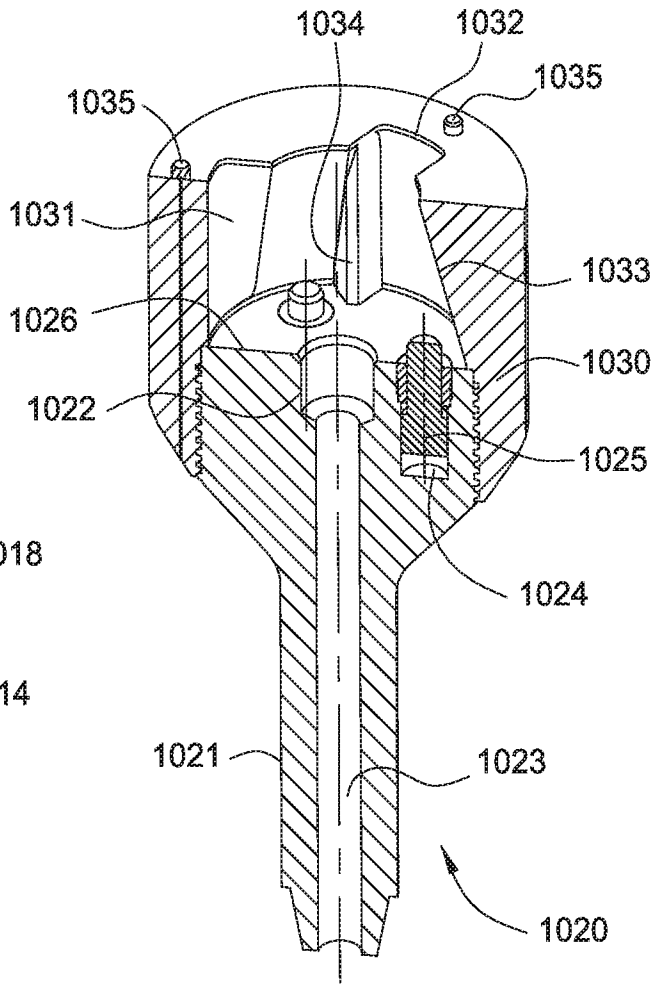
Figure 10A:
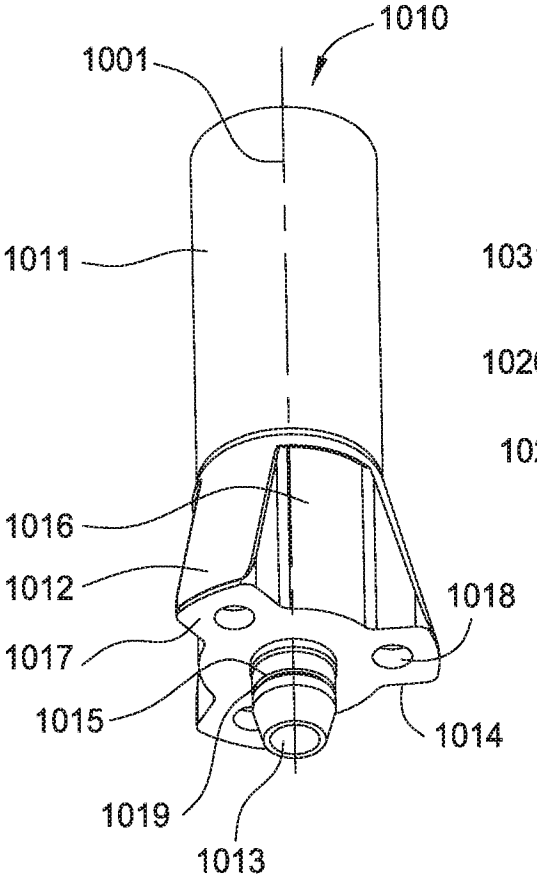

FIGS. 10A-10C schematically illustrate a MCS 1000 according to one embodiment of the present disclosure. The MCS 1000 includes a drive stem 1010 and a tool dock 1020. The drive stem 1010 and the tool dock 1020 may be latched together by matching tapered load shoulders. The drive stem 1010 and the tool dock 1020 may be connected and disconnected by a bayonet mechanism.

FIG. 10A is a schematic perspective view of the drive stem 1010. The drive stem 1010 may include a torque shaft portion 1011, a load shoulder portion 1016, and an end portion 1015. A central bore 1013 may extend through the drive stem 1010 along a longitudinal axis 1001. The torque shaft portion 1011 may be configured to connect with a motor unit, such as the motor unit 4*m* in the drilling system 1 of FIG. 1. The load shoulder portion 1016 may have one or more tapered load shoulders 1012. Each load shoulder 1012 tapers from the end portion 1015 towards the torque shaft portion 1011. The one or more load shoulders 1012 form a bayonet profile 1014 at a bottom surface 1017 of the load shoulder portion 1016. In the embodiment of FIG. 10A, three load shoulders 1012 are formed at substantially equal intervals. Alternatively, other numbers of load shoulders 1012 may be used. Alternatively, the load shoulders 1012 may be formed at substantially unequal intervals to insure that the drive stem 1010 and the tool dock 1020 can be connected at a predetermined orientation. In one embodiment, a locking cavity 1018 may form in the bottom surface 1017 of each load shoulder 1012. The end portion 1015 extends from the bottom surface 1017 with a reduced outer diameter. In one embodiment, the end portion 1015 may include a gland 1019 configured to receive a sealing element 1027.

FIG. 10B is a schematic sectional view of the tool dock 1020. The tool dock 1020 may include a stem 1021 and a housing 1030 joined together. The stem 1021 and the housing 1030 may be joined together by a threaded connection, or other suitable connection means. Alternatively, the tool dock 1020 may be a unitary body. The stem 1021 may include a central bore 1023. A connection recess 1022 may form at an upper end of the central bore 1023 to make a fluid connection with the end portion 1015 of the drive stem 1010. One or more locking blocks 1025 may be movably disposed in one or more recesses 1024 on an upper surface 1026 of the stem 1021. The locking blocks 1025 may be retracted in the recesses 1024 or extended over the upper surface 1026 by actuators, such as by actions of cylinders, or any other form for displacement motors attached to the tool dock 1020. The locking blocks 1025 and the locking cavities 1018 function as a locking mechanism to maintain the connection between the tool dock 1020 and the drive stem 1010. The locking blocks 1025 may be positioned corresponding to the locking cavities 1018 so that the locking blocks 1025 may extend inside the locking cavities 1018 to prevent rotation and create a torque transfer mechanism between the drive stem 1010 and the tool dock 1020.

The housing 1030 may include a cavity 1031 for receiving the load shoulder portion 1016 of the drive stem 1010. The cavity 1031 may have a bayonet profile 1032 matching the bayonet profile 1014 of the drive stem 1010 so that the drive stem 1010 may be stabbed into the tool dock 1020. The housing 1030 may also include tapered load shoulders 1033 matching the load shoulders 1012 of the drive stem 1010. After the drive stem 1010 is inserted into the tool dock 1020, the tool dock 1020 and the drive stem 1010 may rotate relative to each other to engage the tapered load shoulders 1033 and 1012. In one embodiment, the housing 1030 may include one or more stopping face 1034 to prevent further rotation once the tapered load shoulders 1033 are fully engaged.

In one embodiment, one or more couplers 1035 may be attached to the tool dock 1020 for transferring pressured fluid, data, or any other types of signals from the top drive unit to the tool dock 1020. In one embodiment, a sleeve 1040 (shown in FIG. 10C) may be used to engage the one or more couplers 1035. The sleeve 1040 may include couplers 1041 to connect with the couplers 1035. The sleeve 1040 may vertically to connect and disconnect the couplers 1041 and 1035. Alternatively, the couplers 1035 may be disposed in drive stem 1010.

FIG. 10C is a schematic sectional view showing the MCS 1000 in a connected position. To make connection, the drive stem 1010 or the tool dock 1020 may rotate so that the bayonet profiles 1014 and 1032 align with each other. The locking block 1025 may be retracted into the recess 1014. The drive stem 1010 and the tool dock 1020 move relative to each other along the axial direction until the end portion 1015 of the drive stem 1010 form a sealed connection with the connection recess 1022 of the tool dock 1020. The drive stem 1010 and the tool dock 1020 then rotate relative to each other to engage the load shoulders 1012 and 1033. The rotation may be stopped by the stopping surface 1034. The locking blocks 1025 are then extended into the locking cavity 1018 to create a torque transfer connection and to preload the connection. Preloading the connection may avoid chattering of the connection during operation. The sleeve 1040 may then be lowered to make the connections between the couplers 1035 and 1041. To disconnect, the sleeve 1040 may be raised, the locking blocks 1025 retracted. The tool dock 1020 and the drive stem 1010 can then rotate relative to each other to disengage the load shoulders 1012 and 1033. The stopping face 1034 may also stop the rotation when the bayonet profiles 1032 and 1014 are aligned. The drive stem 1010 can then be lifted from the tool dock 1020 to complete the disconnection.

FIGS. 11A-11G schematically illustrate a MCS 1100 according to one embodiment of the present disclosure. The MCS 1100 is similar to the MCS 1000 of FIGS. 10A-10C except that the MCS 1100 includes a guided locking plate 1140 to provide a torque transfer mechanism and/or a connection of couples to transfer pressured fluid, data, or another other types of signals. The MCS 1100 includes a drive stem 1110 and a tool dock 1120. The guided locking plate 1140 is movably disposed in the tool dock 1120.

Figure 11B:
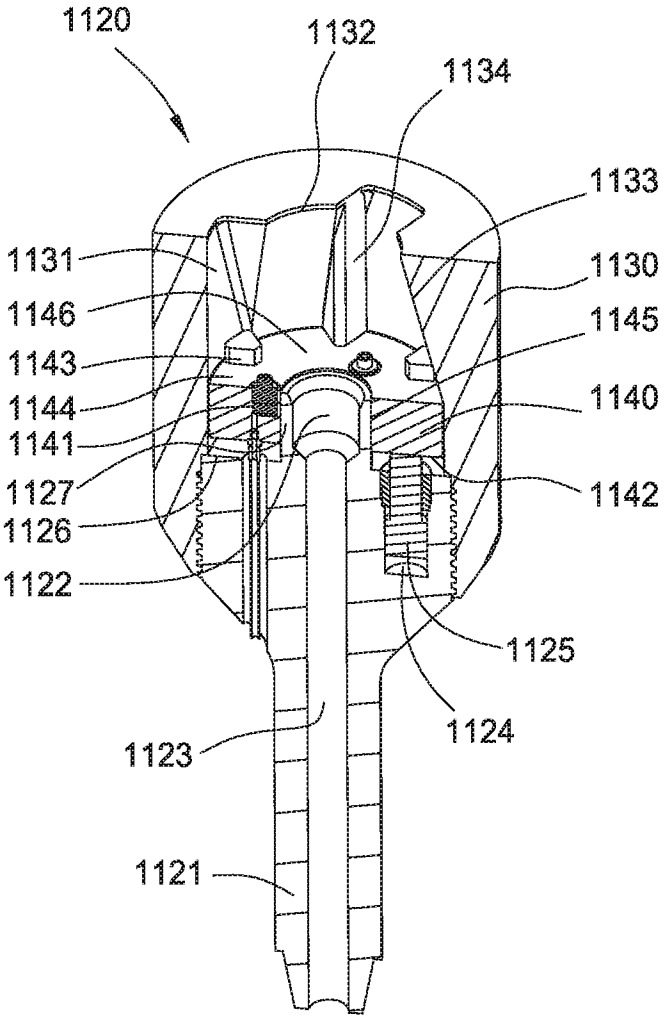
FIGS. 11A-11F illustrates a modular connection system according to another embodiment of the present disclosure.
Figure 11A:
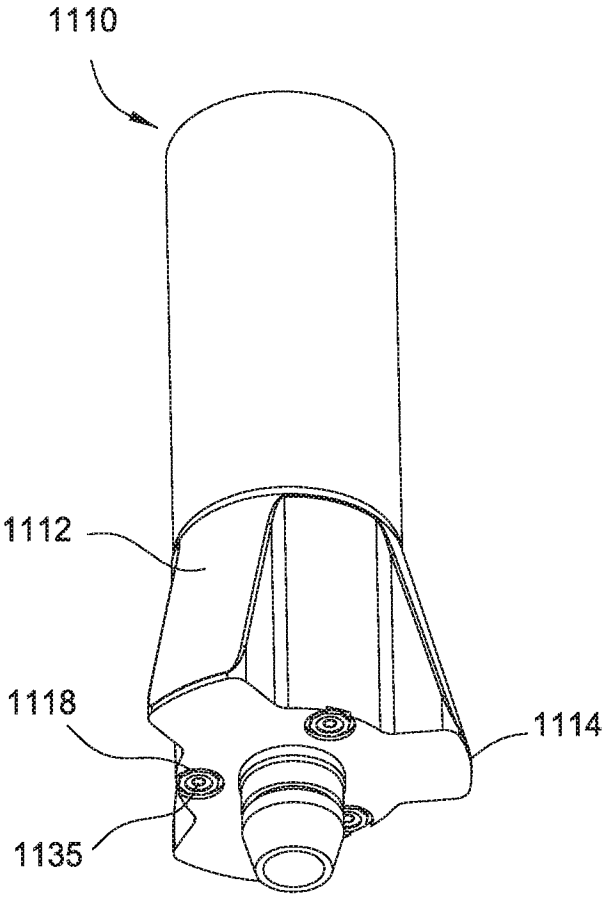

FIG. 11A is a schematic perspective view of the drive stem 1110. The drive stem 1110 is similar to the drive stem 1010 of FIG. 10A except that the drive stem 1110 includes a coupler 1135 in a cavity 1118. The coupler 1135 may be a coupler for to transfer pressured fluid, data, or another other types of signals. In one embodiment, the coupler 1135 may be a female coupler.

FIG. 11B is a schematic sectional view of the tool dock 1120. The tool dock 1120 is similar to the tool dock 1020 of FIG. 10B except that the guided locking plate 1140 is movably disposed in the tool dock 1120. The tool dock 1120 may include a stem 1121 and a housing 1130 joined together. The stem 1121 may include a central bore 1123. A connection recess 1122 may form at an upper end of the central bore 1123 to make a fluid connection with the drive stem 1110. A central tubing 1127 may extend from an upper surface 1126 and form a shoulder to receive the guided locking plate and to form an end stop for the drive stem 1110. One or more plate lift pins 1125 may be movably disposed in one or more recesses 1124 in the upper surface 1126. The plate lift pins 1125 may be retracted in the recesses 1124 or extended over the upper surface 1126 by actuators, such as by actions of cylinders, or any other form for displacement motors attached to the tool dock 1120.

The housing 1130 may include a cavity 1131 for receiving the drive stem 1010. The cavity 1131 may have a bayonet profile 1132 matching a bayonet profile 1114 of the drive stem 1110. The housing 1130 may also include tapered load shoulders 1133 matching load shoulders 1112 of the drive stem 1110. In one embodiment, the housing 1130 may include one or more stopping face 1134.

The guided locking plate 1140 may by a substantially ring shaped plate having a central bore 1145 surrounding the central tubing 1127. A notch 1146 may be formed on an outer diameter of the guided locking plate 1140. The notch 1146 matches the profile of the stopping face 1134 therefore preventing relative rotation between the guided locking plate 1140 and the housing 1130. The guided locking plate 1140 includes an upper surface 1144 and a lower surface 1142. One or more locking blocks 1143 may extend over the upper surface 1144. The one or more locking blocks 1143 may be formed near the outer diameter of the guided locking plate 1140. In one embodiment, the locking blocks 1143 may have a profile similar to the stopping face 1134. The locking blocks 1143 function as a locking mechanism to preload the connection between the tool dock 1120 and the drive stem 1110, therefore, preventing rattling during operation. The locking mechanism also maintains the connection between the tool dock 1120 and the drive stem 1110. When in position, the locking blocks 1143 prevent the drive stem 1110 from rotating relative to the tool dock 1120. The lift pins 1125 interact with the lower surface 1142 to lift or lower the guided locking plate 1140. In one embodiment, one or more couplers 1141 may be disposed in the guided locking plate 1140. The one or more couplers 1141 may be male couplers protruding over the upper surface 1144.

Figures 11C, 11D, 11E, 11F:
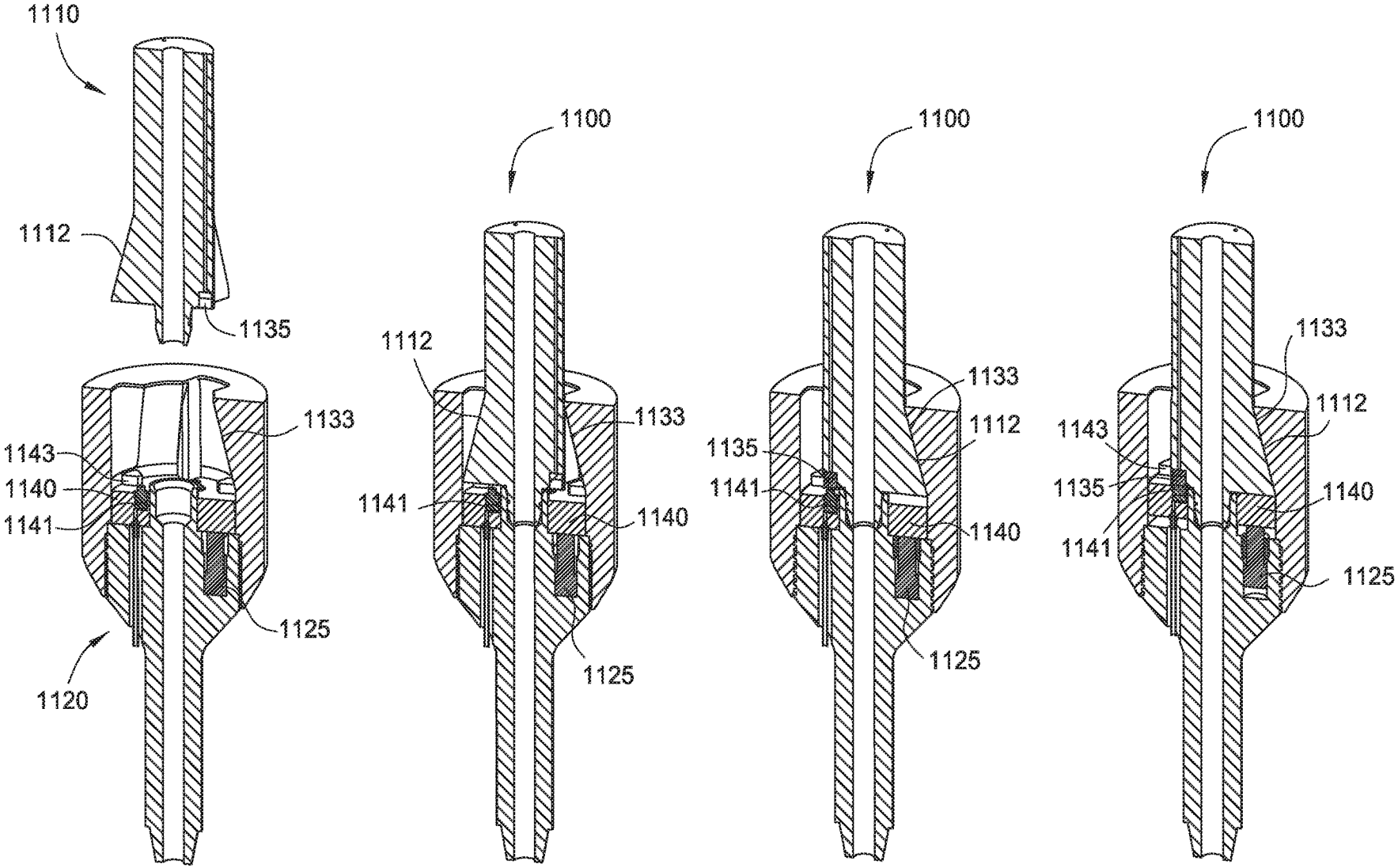

FIGS. 11C-11F are schematic sectional views showing the process of the MCS 1100 making a connection. In FIG. 11C, the drive stem 1110 or the tool dock 1120 may rotate so that the bayonet profiles 1114 and 1132 align with each other. The lift pins 1025 so that the guided locking plate 1140 is at a lower position. In FIG. 11D, the drive stem 1110 and the tool dock 1120 move relative to each other along the axial direction until the drive stem 1110 forms a sealed connection with the connection recess 1122 of the tool dock 1020. In FIG. 11E, the drive stem 1110 and the tool dock 1120 then rotate relative to each other to engage the load shoulders 1112 and 1133. The rotation may be stopped by the stopping surface 1134. When the relative rotation is stopped by the stopping surface 1134, the couplers 1135 also align with the corresponding couplers 1141. In FIG. 11F, the lift pins 1125 are then extended to move the guided locking plate 1140 towards the drive stem 1110 so that the locking block 1143 are raised to interact with the drive stem 1100 and the couplers 1135 and 1141 are connected.

To disconnect, the guided locking plate 1140 may be lowered to disconnect the couplers 1135, 1141 and to disengage the locking block 1143 and the drive stem 1110. The tool dock 1120 and the drive stem 1110 can then rotate relative to each other to disengage the load shoulders 1112 and 1133. The stopping face 1134 may also stop the rotation when the bayonet profiles 1132 and 1114 are aligned. The drive stem 1110 can then be lifted from the tool dock 1120 to complete the disconnection.

FIGS. 12A-12J schematically illustrate a MCS 1200 according to one embodiment of the present disclosure. The MSC 1200 includes a drive stem 1210 that may be engaged with a latch ring 1230 disposed on a tool dock 1220.

Figure 12A:
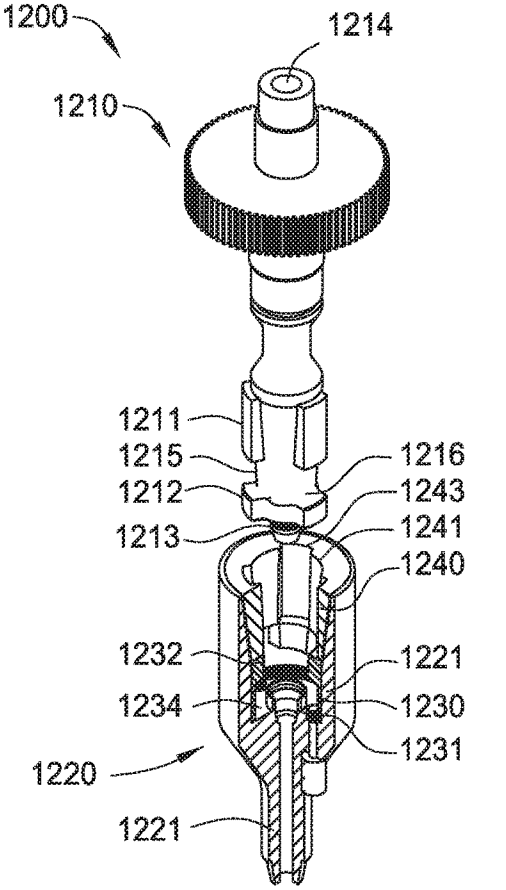
FIGS. 12A-12L illustrates a modular connection system according to another embodiment of the present disclosure
Figure 12B:
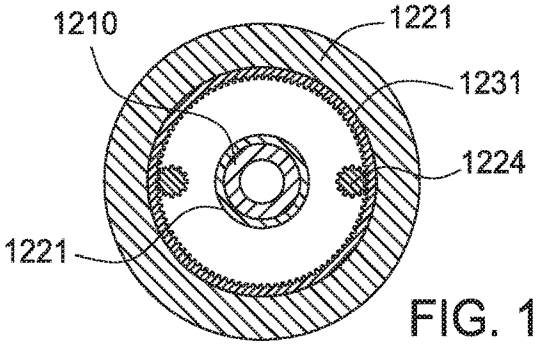
Figure 12C:
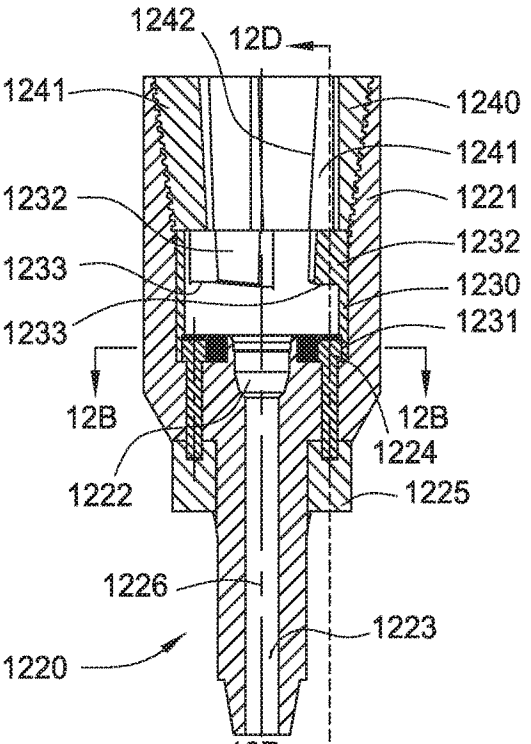
Figure 12D:
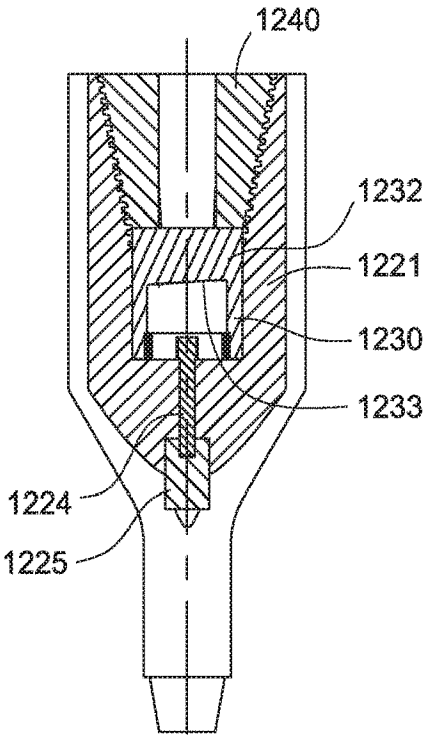

FIG. 12A is a schematic perspective view of the drive stem 1210 and the tool dock 1220. The drive stem 1210 may include a tubular body having a central bore 1214, two or more torque tabs 1211 and two or more latches 1212 extending radially from the tubular body. Each latch 1212 may be aligned with a corresponding torque tab 1211 so that the latches 1212 can pass through a torque profile in the tool dock 1220. In one embodiment, the latches 1212 and the torque tab 1211 may be evenly distributed along a peripheral of the drive stem 1210. In the embodiment of FIG. 12A, there are three latches 1212 and three torque tabs 1212 evenly spaced with each latch 1212/torque tab 1211 occupying a 60 degree section of the torque stem 1210. In one embodiment, the drive stem 1210 may include a tapered profile 1215 above the latches 1212. In one embodiment, each latch 1212 may have a tapered profile 1216 on an upper surface. The drive stem 1210 also includes a seal profile 1213. The seal profile 1213 may receive a seal element to form a sealed connection with the tool dock 1220.

The tool dock 1220 may include a stem 1221, a latch ring 1230 movably disposed in the stem 1221, and a torque housing 1240 coupled to the stem 1221. The stem 1221 may include a central bore 1223. A connection recess 1222 may form at an upper end of the central bore 1223 to make a fluid connection with the seal profile 1213 of the drive stem 1210. The tool dock 1220 may include one or more gear shafts 1224 positioned to rotate the latch ring 1230. An actuator 1225, such as a motor, may be used to drive each gear shaft 1224.

The torque mandrel 1240 may include torque tabs 1241 and pathways 1243 formed between the torque tabs 1241. The pathways 1243 match the torque tabs 1211 of the drive stem 1210. The torque tabs 1211 may have a tapered profile 1242 matching the tapered profile 1215 of the drive stem 1210. The tapered profile 1215 aligns with the tapered profile 1242 that after final engagement reduces the bending moment providing more rigidity in the connection. In one embodiment, the torque mandrel 1240 may be coupled to the stem 1221 by a thread connection. In one embodiment, connecting surfaces between the torque mandrel 1240 and the stem 1221 may also have a tapered profile. The pathways 1243 allow the latches 1212 to pass through and receive the torque tabs 1211 of the drive stem 1210.

The latch ring 1230 may be a tubular section having inner gears 1231 formed at a lower portion 1234. The inner gears 1231 mate with the one or more gear shafts 1224. The rotation of the gear shafts 1224 drives the latch ring 1230 to rotate about a central axis 1226. Latches 1232 are formed on an upper portion of the latch ring 1230. Each latch 1232 may include a tapered lower surface 1233 matching the tapered surface 1216 of the latches 1212 of the drive stem 1210. Pathways 1235 (shown in FIG. 12H) are formed between the latches 1232 to allow the latches 1212 to be inserted below the latches 1232. The latch ring 1230 may be rotated to engage the latches 1212 and 1232. The tapered surfaces 1216, 1233 compensate wear of the latches 1212, 1232.

Similar to the MSC 1000 of FIGS. 10A-10C, couplers to transfer pressured fluid, data, or any other type of signal from the top drive to the tool dock 1220 may be engaged by the action of a sleeve (not shown) that move up and down connected to the drive stem 1210 (not shown). Alternatively, the couplers can also be incorporated in the drive stem 1210 and tool dock 1220 where flow channels are drilled through the stem and tool housing allowing fluid transfer and data transmission.

Figure 12H:
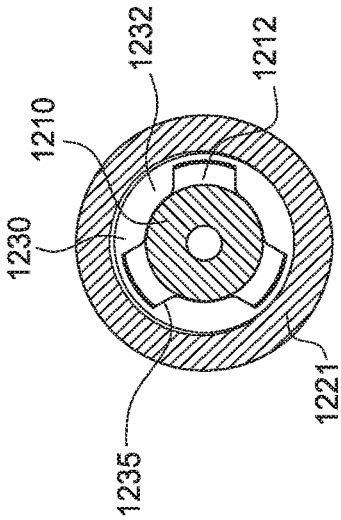
Figure 12G:
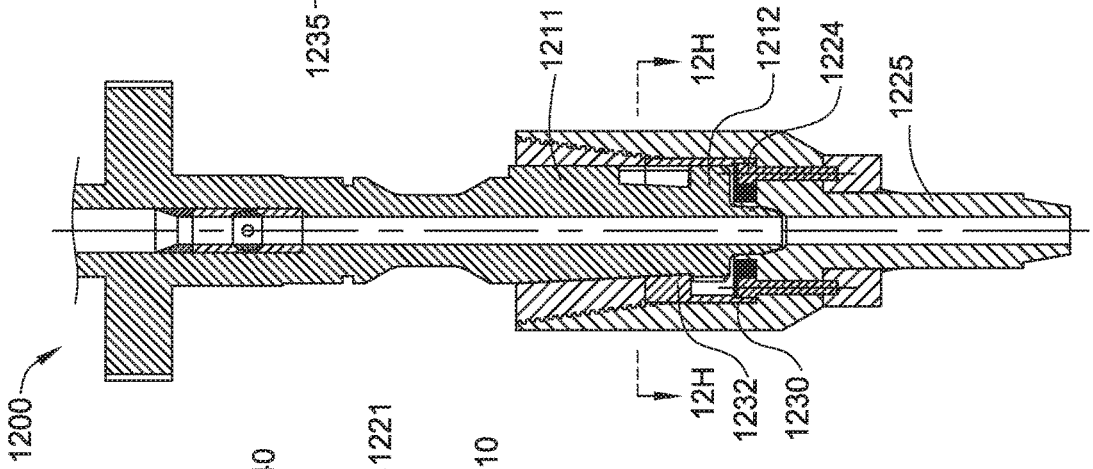
Figure 12F:
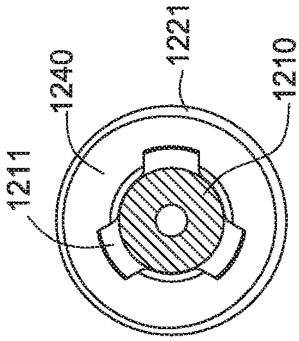
Figure 12E:
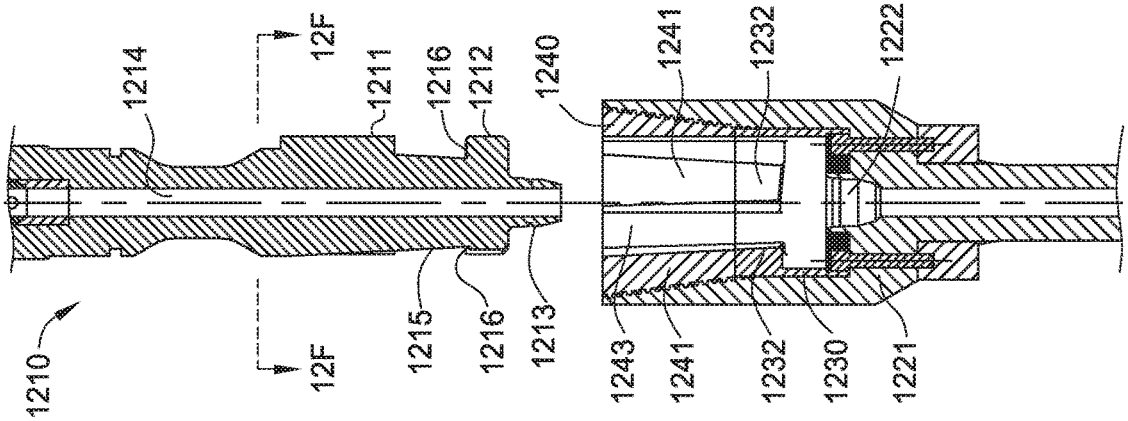
Figure 12L:
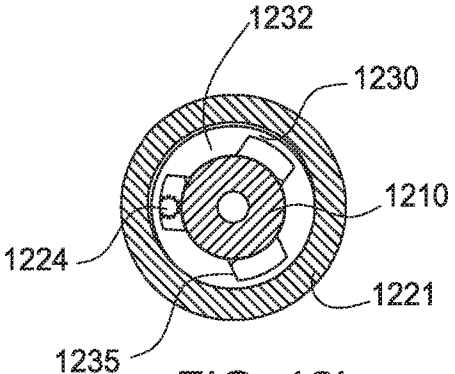
Figure 12K:
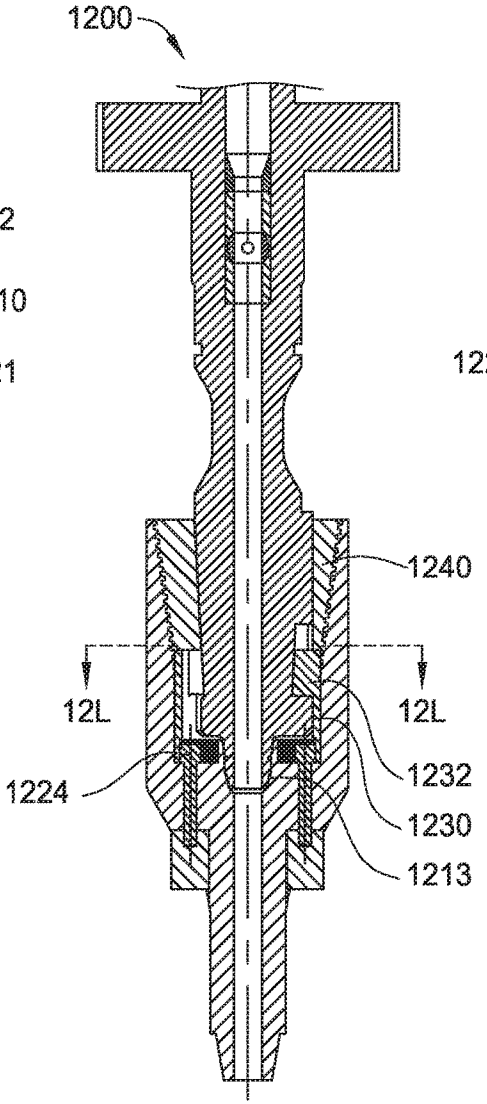
Figure 12J:
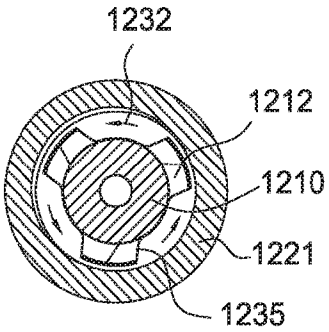
Figure 12I:
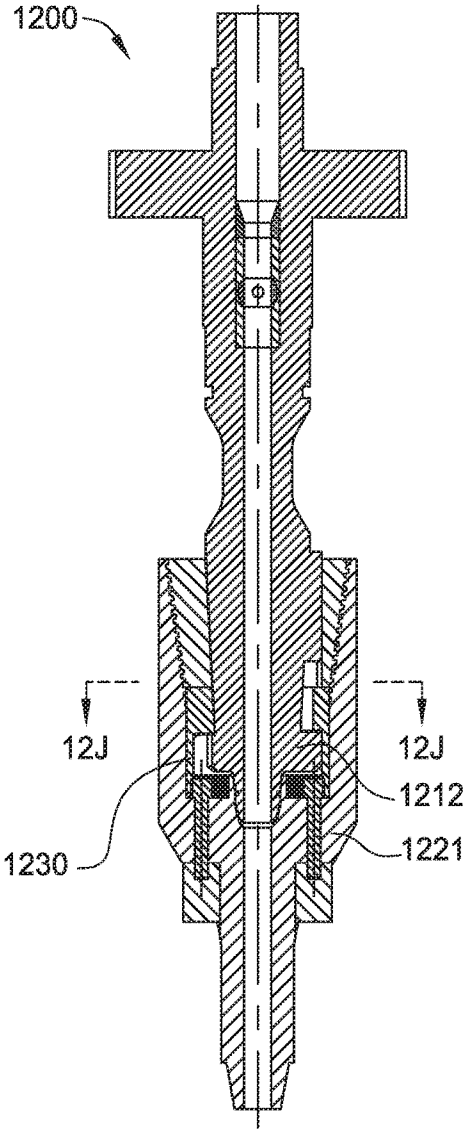

FIGS. 12E-12L are schematic sectional views showing the process of the MCS 1200 making a connection. In FIGS. 12 E and 12F, the drive stem 1210 or the tool dock 1220 may rotate so that the latches 1212 and the torque tabs 1211 of the drive stem 1210 align with the pathways 1243 of the tool dock 1220. The latch ring 1230 is also rotated so that the pathways 1235 align with the pathways 1243, therefore, allowing the latches 1212 to insert below the latches 1232 of the latch ring 1230. In FIGS. 12G and 12H, the drive stem 1210 and the tool dock 1220 move relative to each other along the axial direction until the seal profile 1213 of the drive stem 1210 forms a sealed connection with the connection recess 1222 of the tool dock 1220. In FIGS. 121 and 12J, the latch ring 1230 is rotate to move the latches 1232 on the latch ring 1230 towards the latches 1212 on the drive stem 1210. In FIGS. 12K and 12L, the latch ring 1230 is rotated to a position where the latches 1232 and the latches 1212 are engaged with each other. The torque provided to the latch ring 1230 will determine the preload force acting on the connection.

To disconnect, the latch ring 1230 may be rotated to disengage the latches 1212 and 1232. The drive stem 1210 can then be lifted from the tool dock 1220 to complete the disconnection.

Even though the latch ring 1230 in the MCS 1200 is actuated by drive unit with gears, the latch ring 1320 may be coupled to any suitable actuators. For example, a hydraulic/pneumatic cylinder may be used to act on the latch ring 1320 directly or through a linkage. Alternatively, the latch ring 1320 may be driven by electric drive unit.

Figure 13C:
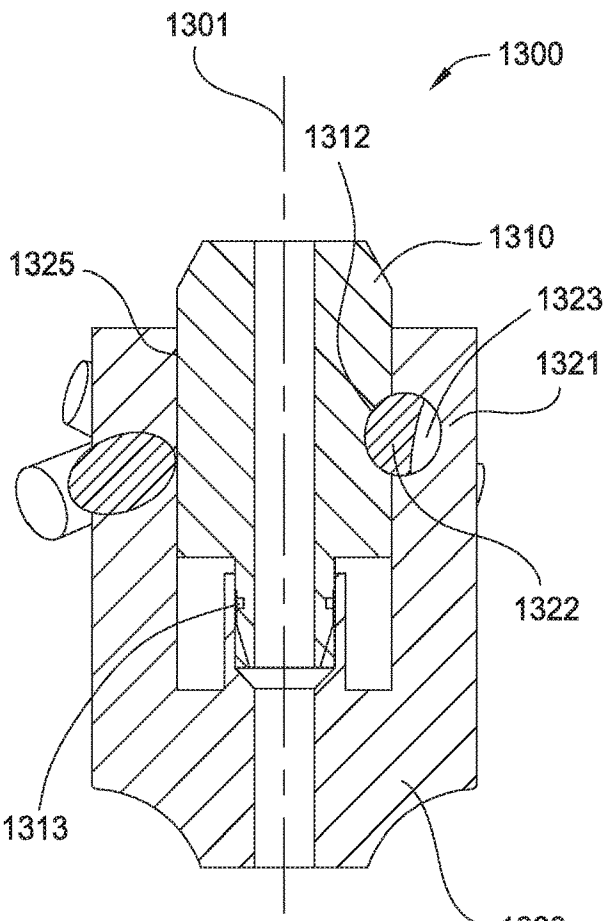
FIGS. 13A-13C illustrates a modular connection system according to another embodiment of the present disclosure.
Figure 13B:
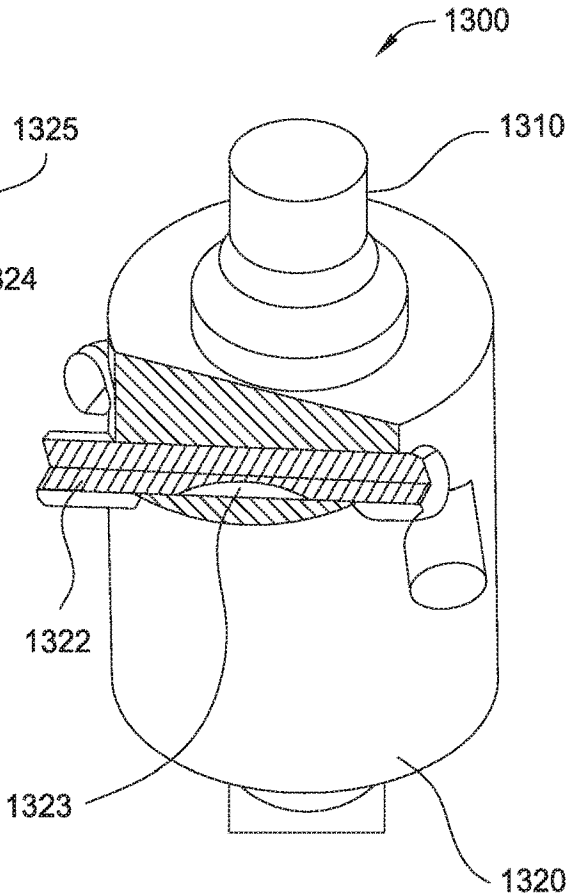
Figure 13A:
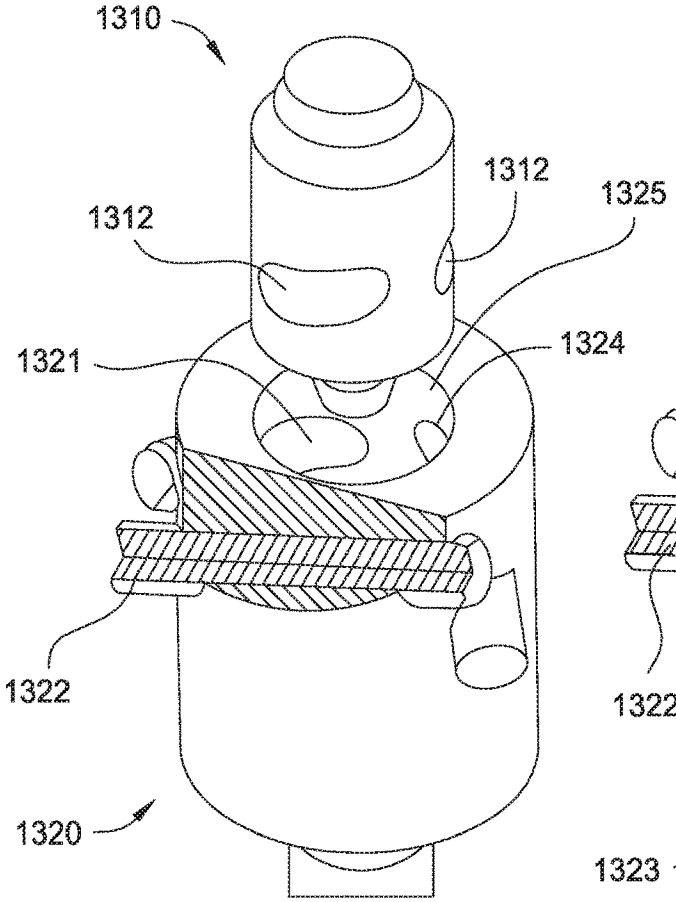

FIGS. 13A-13C schematically illustrate a MCS 1300 according to another embodiment of the present disclosure. The MSC 1300 includes a drive stem 1310 and a tool dock 1320 coupled together by locking pins 1322. The drive stem 1310 may have cutouts 1312 formed on an outer surface. The cutouts 1312 may be cylindrical cutouts. In one embodiment, the cutouts 1312 may be equally spaced. The cutouts 1312 are machined in an angle from respect to a central axis 1301 of the drive stem 1310 so that the cutouts 1312 can be used to support torque load and axial load. The drive stem 1310 has a seal profile 1313 at its end to seal the connection between the drive stem 1310 and tool dock 1320 preventing high pressure fluids from leaking out of the connection.

The tool dock 1320 may have cavities 1321 formed corresponding to the cutouts 1312. Each cavity 1321 may have an opening 1324 at an inner surface 1325 of the tool dock 1320. In one embodiment, the cavities 1321 may be cylindrical cavities. The cavities 1321 are formed in an angle in the same manner as the cutouts 1312 to support torque and axial loads. The cavities 1321 and the cutouts 1312 may be machined, such as by drilling, on the surface of the tool dock 1320. A locking pin 1322 may be inserted in each of the cavities 1321. In one embodiment, the locking pin 1322 may be cylindrical pins rotatable in the cavities 1321. Each locking pin 1322 may include a cutout 1323 to enable the locking pin 1322 to engage and disengage the drive stem 1310.

To make the connection, the locking pins 1322 may be rotated to align the cutouts 1323 on the locking pins 1322 with the openings 1324 of the cavities 1321 so that the drive stem 1310 can be stabbed into the tool dock 1320. When the drive stem 1310 is stabbed in the tool dock 1320, the cutouts 1312 may be aligned with the corresponding cavities 1321.

The locking pins 1322 can then be rotated to occupy the cutouts 1312 in the drive stem 1310 to secure the connection. The locking pins 1322 may be eccentric creating a load against a stop shoulder on the drive stem 1310 or tool dock 1320 during final step of pin rotation. Alternatively, torque transfer can also be achieved using a torque profile such as spline, tabs, gear, or similar incorporated in the drive stem 1310 and the tool dock 1320.

Similar to the MSC 1000 of FIGS. 10A-10C, couplers to transfer pressured fluid, data, or any other type of signal from the top drive to the tool dock 1320 may be engaged by the action of a sleeve (not shown) that move up and down connected to the drive stem 1310. Alternatively, the couplers can also be incorporated in the drive stem 1310 and tool dock 1320 where flow channels are drilled through the stem and tool housing allowing fluid transfer and data transmission.

FIGS. 14A-14J schematically illustrate a MCS 1400 according to one embodiment of the present disclosure. The MCS 1400 includes a drive stem 1410 and a tool dock 1420 connectable by a set of locking blocks with eccentric axes.

Figures 14A, 14B, 14C, 14D:
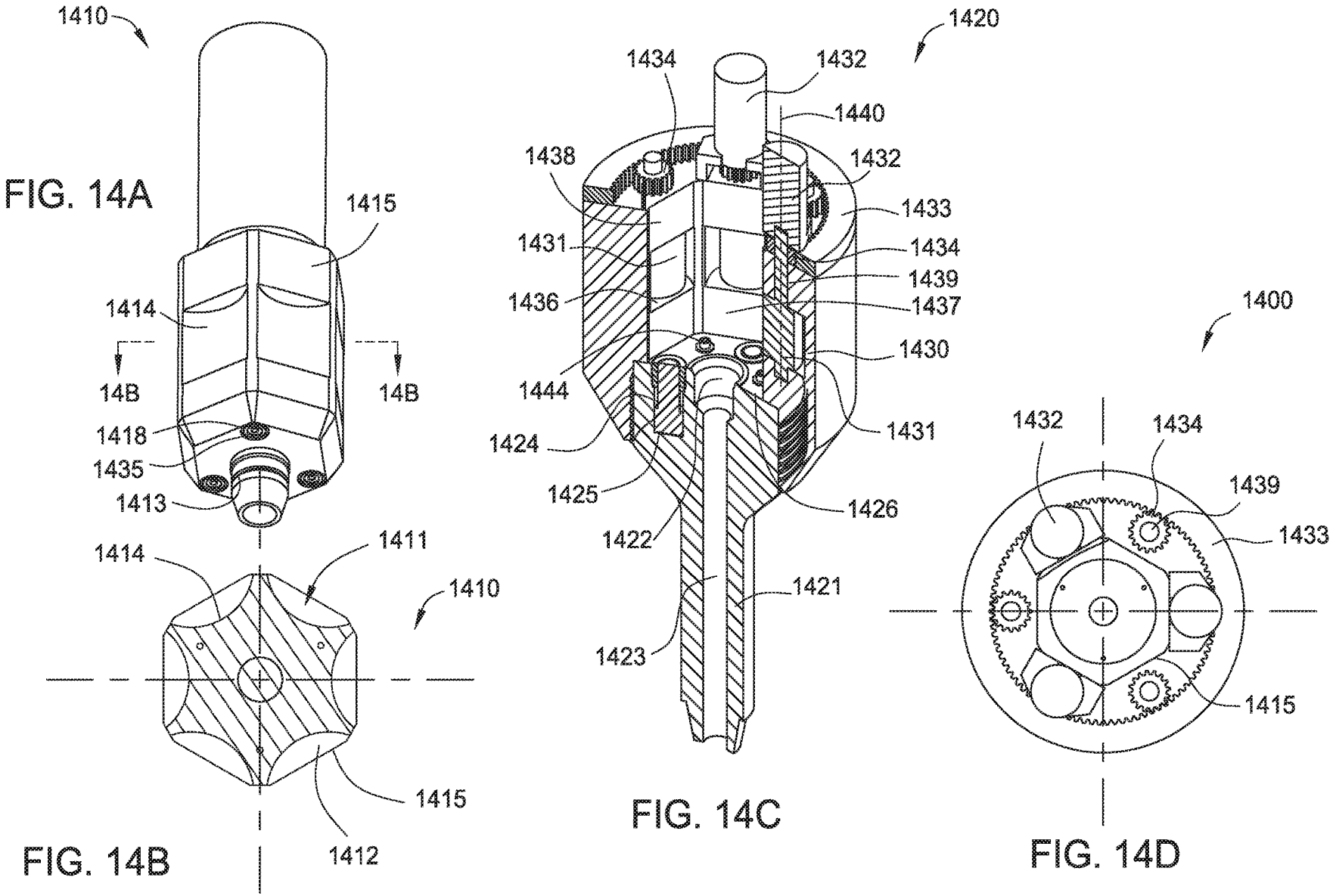

FIG. 14A is a schematic perspective view of the drive stem 1410. FIG. 14B is a sectional view of the drive stem 1410 showing torque profiles 1414. The drive stem 1410 include two or more cutouts 1411 on an outer surface 1415. In one embodiment, the cutouts 1411 may be evenly spaced on the outer surface 1415. FIG. 14B is a schematic sectional view of the drive stem 1410. In one embodiment, the outer surface 1415 of the drive stem 1410 may be a polygonal. In FIG. 14B, the outer surface 1415 is a hexagon having a cutout 1411 formed on each side. Each cutout 1411 may be cylindrical cutouts along an axial direction of the drive stem 1410. Each cutout 1411 may have axial load shoulders 1412 and a torque profile 1414. The drive stem 1410 may include a seal profile 1413 to form a fluid connection with the tool dock 1420. The drive stem 1410 may include one or more couplers 1435 disposed in cavities 1418. The coupler 1435 may be a coupler for to transfer pressured fluid, data, or another other types of signals. In one embodiment, the coupler 1435 may be a female coupler.

FIG. 14C is a schematic sectional view of the tool dock 1420. The tool dock 1420 may include a stem 1421 and a housing 1430 joined together. The stem 1421 may include a central bore 1423. A connection recess 1422 may form at an upper end of the central bore 1423 to make a fluid connection with the drive stem 1410. One or more lift pins 1425 may be movably disposed in one or more recesses 1424 in an upper surface 1426 of the stem 1421. The lift pins 1425 may be retracted in the recesses 1424 or extended over the upper surface 1426 by actuators, such as by actions of cylinders, or any other form for displacement motors attached to the tool dock 1420. In one embodiment, couplers 1444 may be disposed on the upper surface 1426. The couplers 1444 are positioned to connect with the couplers 1435 in the drive stem 1410.

The housing 1430 may include a cavity 1437 for receiving the drive stem 1410. In one embodiment, the cavity 1437 may be a polygonal cavity. In FIG. 14C, the cavity 1437 is a hexagonal cavity. In each surface 1438 of the cavity 1437, a recess 1436 is formed. A locking pin 1431 is disposed in each recess 1436. In one embodiment, the locking blocks 1432 are cylindrical columns. Alternatively, the locking pins 1431 may be any suitable shape. Each locking pin 1431 may have a shaft 1439 along an eccentric axis 1440. Each locking pin 1431 may be rotated about the eccentric axis 1440 through the shaft 1439. Rotation about the eccentric axis 1440 allows the locking pin 1431 to be complete retracted in the recess 1436 during connection or extended out of the recess 1436 to transfer loads.

Each shaft 1439 extends over the housing 1430 and connects to a gear 1434. FIG. 14D is a schematic top view of the MCS 1400. As shown in FIG. 14D, all of the gears 1434 mate with a gear ring 1433. At least one drive motor 1432 may be connected to of one of the shafts 1439. The drive motor 1432 rotates the shaft 1439 to turn the gear 1434 and the locking pin 1431 about the eccentric axis 1440. The rotation of the gear 1434 causes the gear ring 1433 to rotate. The gear ring 1433 in turn rotates all other gears 1434 and all the locking pins 1431. As a result, the gear ring 1433 enables synchronized rotation of all the locking pins 1431. Three drive motors 1432 are coupled to the shafts 1439.

Figure 14E:
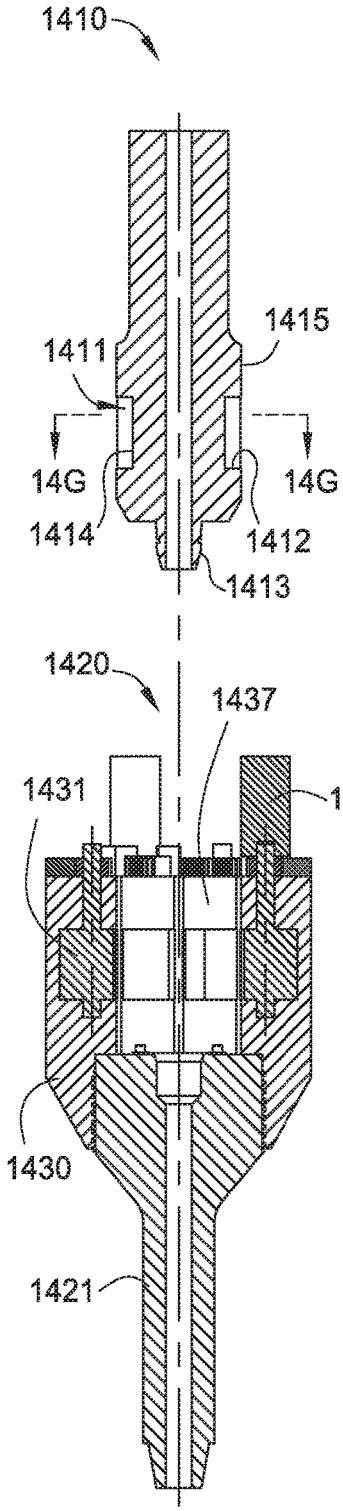
Figure 14F:
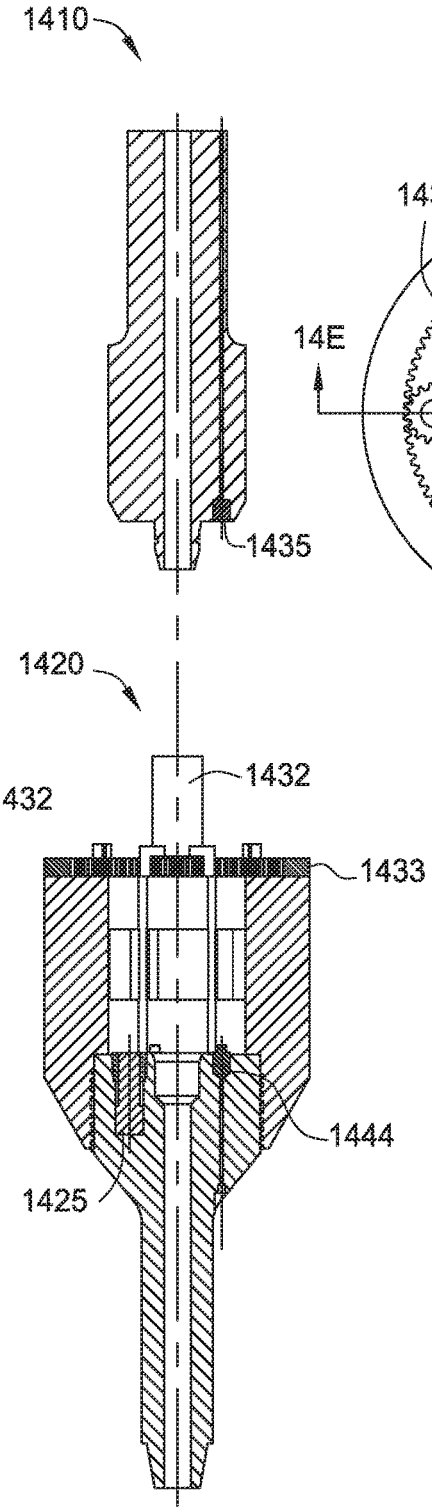
Figure 14G:
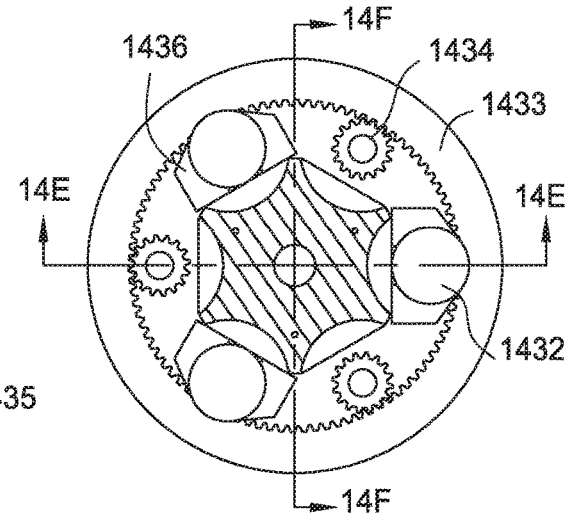
Figure 14M:
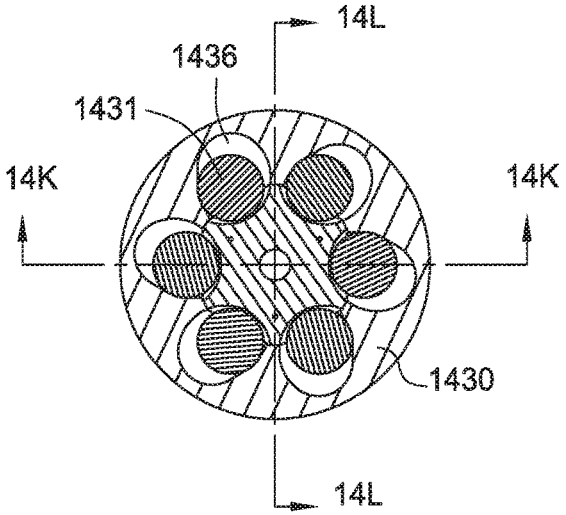
Figure 14K:
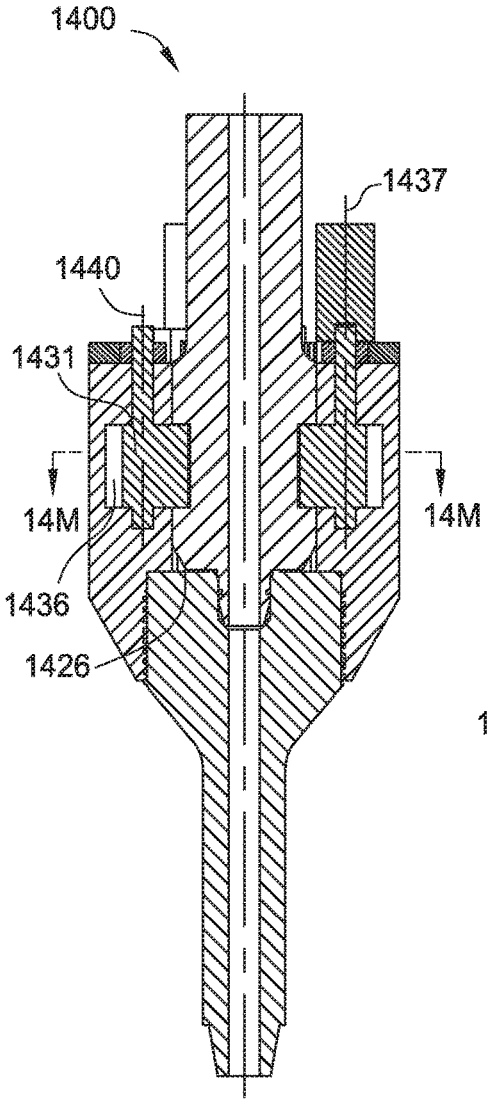
Figure 14L:
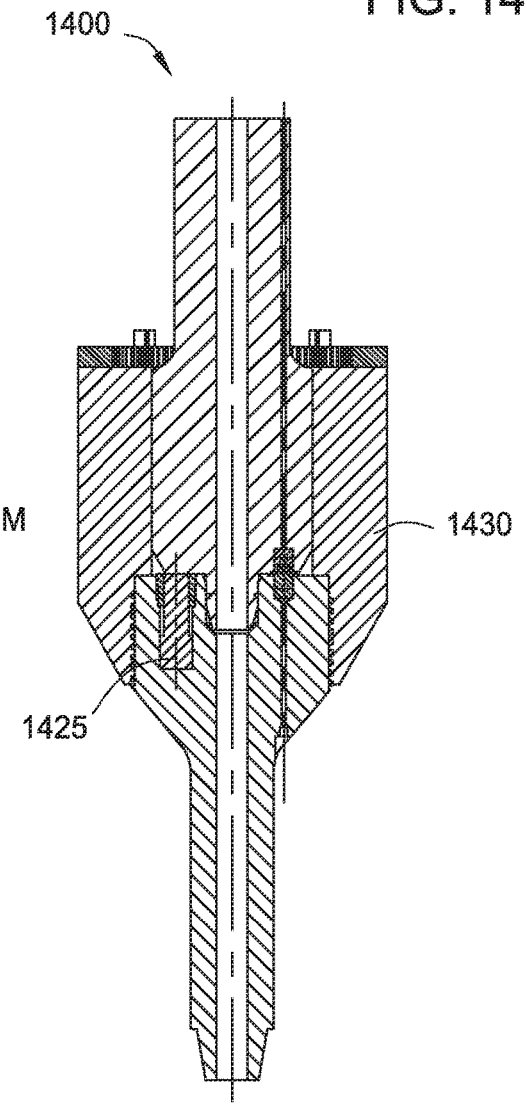

FIGS. 14E-14M are schematic sectional views showing the process of the MCS 1400 making a connection. In FIGS. 14E, 14F, and 14G, the drive stem 1410 or the tool dock 1420 may rotate so that the cavity 1437 of tool dock 1420 aligns with the outer surface 1415 of the drive stem 1410. The couplers 1435 also align with the corresponding couplers 1444. All the locking pins 1431 are retracted inside the recesses 1436 so that the drive stem 1410 may be stabbed into the tool dock 1420. In FIGS. 14H, 14I, and 14J, the drive stem 1410 and the tool dock 1420 move relative to each other along the axial direction until the drive stem 1410 forms a sealed connection with the connection recess 1422 of the tool dock 1420. The couplers 1435 and the couplers 1444 are also connected. In FIGS. 14K, 14L, and 14M, the locking pins 1431 are rotated about the eccentric axes 1440 so that a portion of each locking pin 1431 occupies the corresponding cutout 1411. In one embodiment, the height of the cutout 1411 may be larger than the height of the locking pin 1431. To avoid rattling during operation, the lift pins 1425 may be raised over the top surface 1426 to lift the drives stem 1410, therefore compressing the load surface 1412 of the drive stem 1410 against the locking block 1432. The lift pins 1425 may also be lifted to provide thread compensation. The drive stem 1410 and the tool dock 1420 are connected.

To disconnect, the lift pins 1425 may be lowered to release the preload. The locking pins 1431 can then be rotated to retract back to the recesses 1436. The drive stem 1410 can then be lifted from the tool dock 1420 to complete the disconnection.

The MCS 1000, 1100, 1200, 1300, 1400 disclosed above may be used in place of the MCS 4*y* with any suitable top drive tools, such as a drilling tool, a cementing tool, a casing tool, a completion tool, a wireline tool, a fracturing tool, a pump, or a sand screen.

It should be noted even though, in the embodiments described above, the tool docks are connected to a tool and the drive stems are connected to a top drive unit, structures of the tool docks may be connected to a top drive unit while structures of the corresponding drive stems may be connected to a tool.

In one embodiment, tools having a tool dock as described in any of the MCS's above may be store in a storage unit. The storage unit may have one or more tool receiving slots. Each tool receiving slot may receive a tool dock in the same manner as the drive stem corresponding to the tool dock. In one embodiment, a system may include a top drive unit, a tool storage unit, and one or more tools. The one or more tools may be connected to the top drive unit and stored in the tool storage unit using the same MCS according to embodiments of the present disclosure.

In one embodiment, tools having a tool dock as described in any of the MCS's above may be store in a storage unit. The storage unit may have one or more tool receiving slots. Each tool receiving slot may receive a tool dock in the same manner as the drive stem corresponding to the tool dock. In one embodiment, a system may include a top drive unit, a tool storage unit, and one or more tools. The one or more tools may be connected to the top drive unit and stored in the tool storage unit using the same MCS according to embodiments of the present disclosure.

In one embodiment, tools having a tool dock as described in any of the MCS's above may be store in a storage unit. The storage unit may have one or more tool receiving slots. Each tool receiving slot may receive a tool dock in the same manner as the drive stem corresponding to the tool dock. In one embodiment, a system may include a top drive unit, a tool storage unit, and one or more tools. The one or more tools may be connected to the top drive unit and stored in the tool storage unit using the same MCS according to embodiments of the present disclosure.

One embodiment of the present disclosure provides a modular connection system for a top drive. The modular connection system includes a housing having a bore therethrough, a plurality of latch blocks disposed in the housing and movable relative thereto between an extended position and a retracted position, a stem insertable into the housing bore and having a shoulder formed in an outer surface thereof for mating with the latch blocks in the extended position, a torsional profile formed in one of an inner and outer surface of the housing, and a torsional coupling formed in or attached to the other one of an outer and inner surface of the stem, wherein the torsional coupling is engaged with the torsional profile when the latch blocks are engaged with the shoulder.

The above modular connection system may also include an actuator for moving the latch blocks between the extended and retracted positions.

The above modular connection system may further include a plurality of sockets disposed in and connected to the housing, and each latch block has an end disposed in the respective socket for pivoting relative thereto between an extended position and a retracted position.

The above modular connection system may further include a cam having a notch formed through a wall thereof for each latch block, walls of the cam adjacent the notches have actuation grooves formed therein, and each latch block has a tongue formed in an outer surface thereof and protruding from each lateral face thereof into adjacent actuation grooves.

In the above modular connection system, the actuator may include a piston and cylinder assembly disposed in the housing and connected to the cam.

The above modular connection system further includes a follower having a notch formed through a wall thereof for each latch block, lateral faces of the latch blocks have actuation grooves formed therein, and the follower has tongues formed therein adjacent to the notches and protruding into adjacent actuation grooves.

In the above modular connection system, the actuator may be linear. The actuator may be located at an exterior of the housing. The housing may have a window formed through a wall thereof for each block. The system may further include a link arm pivotally connected to each latch block and extending through a respective window, and a ring pivotally connected to the link arms and disposed around the housing.

The above modular connection system may further include a control junction. The control junction may be connected when the latch blocks are engaged with the shoulder. A first member of the control junction may be connected to the torsional coupling, a second member of the control junction may be connected to the housing adjacent to the torsional profile.

The above modular connection system may further include a control swivel disposed around and connected to the shaft, and the housing has a slot or passage formed in and along an outer surface or wall thereof for routing of a control line from the control swivel to the control junction.

The above modular connection system may further include a shaft for being rotated by a drive motor of the top drive. The housing may be connected to the shaft. The system may further include a plurality of stems, and each stem is insertable into the housing bore and has a shoulder formed in an outer surface thereof for mating with the latch blocks in the extended position.

In the above modular connection system, the shaft may be a torque shaft. The system may further include a torque sub. The torque sub may include a non-rotating interface, a recess formed in an outer surface of the torque shaft, a strain gage disposed on the torque shaft at the recess and oriented to measure torque exerted thereon, a transmitter disposed on the torque shaft, in communication with the strain gage, and operable to wirelessly transmit the torque measurement to the interface, a turns gear torsionally connected to the torque shaft, and a proximity sensor connected to the interface and located adjacent to the turns gear.

In above modular connection system, the shaft may be a load shaft. The system may further include a load sub. The load sub may include a non-rotating interface, a recess formed in an outer surface of the load shaft, a strain gage disposed on the load shaft at the recess and oriented to measure longitudinal load and bending moment exerted thereon, and a transmitter disposed on the torque shaft, in communication with the strain gage, and operable to wirelessly transmit the torque measurement to the interface.

The above modular connection system may further include a drilling unit. The drilling unit may include one of the stems, and a thread saver. The drilling unit may further include an internal blowout preventer. The internal blowout preventer comprises an automated shutoff valve. The stem of the drilling unit, the thread saver, and the internal blowout preventer may be integrated into a single tube.

The above modular connection system may further include a casing unit. The casing unit may include one of the stems, a clamp comprising a set of grippers for engaging a surface of a joint of casing, thereby anchoring the casing joint to the casing unit, and an actuator for selectively engaging and disengaging the clamp with a casing joint. The casing unit may further include a stab seal for engaging an inner surface of the casing joint. The casing unit may further include a casing handler. The casing handler may include a swivel comprising a rotating barrel and a non-rotating barrel, a pair of bails pivotally connected to the non-rotating barrel, a casing elevator pivotally connected to the bails, and a link tilt pivotally connected to the non-rotating barrel and to the bails.

The above modular connection system may further include a control junction. The control junction may be connected when the latch blocks are engaged with the respective shoulder. A first control line may be connected to the link tilt and the non-rotating barrel, and a second control line may be connected to the rotating barrel and the control junction.

The above modular connection system may further includes a cementing unit. The cementing unit may include one of the stems, an internal blowout preventer, and a cementing swivel. The cementing swivel may include a housing having an inlet formed through a wall thereof for connection of a cement line, a housing connected to the respective quill and having a port formed through a wall thereof in fluid communication with the inlet, a bearing for supporting rotation of the housing relative to the housing, and a seal assembly for isolating the inlet-port communication. The cementing unit may further include a launcher. The launcher may include a body connected to the housing of the cementing swivel, a dart disposed in the launcher body, and a gate having a portion extending into the launcher body for capturing the dart therein and movable to a release position allowing the dart to travel past the gate.

Embodiment of the present disclosure may include a modular top drive system for construction of a wellbore including one of the above modular connection systems, and a motor unit. The motor unit may include a drive body, the drive motor having a stator connected to the drive body, a trolley for connecting the drive body to a rail of a drilling rig, and a quill torsionally connecting the shaft to a rotor of the drive motor.

The above modular top drive system may further comprises a pipe handler. The pipe hander may include a handler body connected to the drive body, a pair of bails pivotally connected to the handler body, and a backup wrench. The backup wrench may include an arm, an upper hinge pivotally connecting the arm to the handler body, a pair of tong segments, a lower hinge pivotally connecting the tong segments to the arm, and a tong actuator pivotally connected to the arm and the tong segments and operable to move the tong segments between an engaged position with a drill string and a stowed position adjacent to the rail.

In the above modular top drive system, the motor unit may further comprise a becket connected to the drive body for receiving a hook of a traveling block, a mud swivel comprising an outer barrel connected to the drive body and an inner barrel having an upper portion disposed in the outer barrel and a stinger portion for stabbing into a seal receptacle of the quill, a nipple connected to the outer barrel for receiving a mud hose, and a down thrust bearing for supporting the quill for rotation relative to the drive body. The motor unit may further include a drive gear torsionally connecting the rotor to the quill.

One embodiment of the present disclosure provides a modular connection system. The modular connection system includes a first tubular component having a first bore therethrough and a second tubular component having a second bore. The first tubular component includes a first seal profile around the first bore, and one or more first load transfer features. The second tubular component includes a second seal profile around the second bore. The first seal profile is shaped to match the second seal profile and to form a fluid connection between the first and second bores, and one or more second load transfer features matching the one or more first load transfer features of the first tubular component. The first tubular component is inserted to the second tubular component to make a connection to transfer fluid, axial loads, and torsional loads.

In one or more embodiments of the present disclosure, the first tubular component further comprises one or more first couplers, the second tubular component further comprises one or more second couplers matching the one or more first couplers, when the first tubular component is inserted into the second tubular component, the first and second couplers connect to each other to transfer pressured fluid, data, or other signals between the first and second tubular components.

In one or more embodiments of the present disclosure, the second tubular component includes a housing, and the one or more second load transfer features include a plurality of latch blocks disposed in the housing and movable relative to the housing between an extended position and a retracted position, and the one or more first transfer features of the first tubular component includes a shoulder to engage the plurality of latch blocks when the first tubular is inserted into the housing of the second tubular.

In one or more embodiments of the present disclosure, the second tubular component further comprises a socket member disposed in and connected to the housing, wherein each latch block has an end disposed in the socket member for pivoting relative to the housing between the extended position and the retracted position.

In one or more embodiments of the present disclosure, the second tubular member further comprises one or more cams positioned to move the plurality of latch blocks.

In one or more embodiments of the present disclosure, the one or more first load transfer features of the first tubular component includes: two or more tapered load shoulders, wherein the two or more tapered load shoulders are spaced apart and form a bayonet profile, and the second tubular component comprising a housing having a bayonet profile and two or more tapered load shoulders matching the two or more load shoulders of the first tubular component, and the first tubular component stabs into the second tubular component and rotates relative to the second tubular to make the connection.

In one or more embodiments of the present disclosure, the first tubular component includes two or more locking cavities, the second tubular component comprises two or more locking blocks, and the locking blocks are movable to insert into and remove from the locking cavities.

In one or more embodiments of the present disclosure, the second tubular component further comprises a guided locking plate having one or more locking blocks formed thereon, and one or more actuators positioned to raise and lower the guided locking plate and insert the one or more locking blocks into the locking cavities and remove the one or more locking blocks from the locking cavities.

In one or more embodiments of the present disclosure, the one or more first load transfer features includes two or more torque tabs, and two or more latches, and the second load transfer features includes two or more torque tabs, and a latch ring, and the first tubular component stabs into the second tubular component and the latch ring rotates relative to the first tubular component to make the connection.

In one or more embodiments of the present disclosure, the first tubular component has a tapered shaft profile.

In one or more embodiments of the present disclosure, the two or more latches have tapered surfaces to engage the latch ring.

In one or more embodiments of the present disclosure, the one or more first load transfer features of the first tubular component includes two or more cutouts formed on an outer surface, the second load transfer features of the second tubular component includes two or more lock pins disposed in a housing, each lock pin has a cutout, the lock pins rotate to occupy the cutouts in the first tubular component to make the connection.

In one or more embodiments of the present disclosure, the cutouts are formed at an angle relative to an axial direction of the drive stem to support axial and torsional loads.

In one or more embodiments of the present disclosure, the cutouts are cylindrical cutouts along an axial direction of drive stem, and the locking pins are rotatable about an eccentric axis.

In one or more embodiments of the present disclosure, the second tubular component further comprises one or more lift pin movable to apply a preload between the first tubular component and the second tubular component.

In one or more embodiments of the present disclosure, the housing of the second tubular member includes a stopping surface to stop the rotation of the first tubular member.

One embodiment of the present disclosure provides a drive stem adapted to connect with a top drive. The drive stem includes a body having a bore therethrough, a seal profile around the bore, and one or more load transfer features formed on an outer surface or an inner surface of the body, and one or more couplers disposed on the body to transfer pressured fluid, electric power, data, or other signals.

In one or more embodiments of the present disclosure, the drive stem further comprises a locking mechanism.

In one or more embodiments of the present disclosure, the locking mechanism is actuated using pressured fluid, electric power, or other source of power.

In one or more embodiments of the present disclosure, the one or more load transfer features comprise two or more latches, and two or more torque tabs.

One embodiment of the present disclosure provides a tool dock comprising a body having a bore, one or more load transfer features formed on an inner surface or an outer surface of the body, and one or more couplers disposed on a housing to transfer pressured fluid, electric power, data, or other signals.

In one or more embodiment of the present disclosure, the tool dock further comprises a locking mechanism.

In one or more embodiments of the present disclosure, the locking mechanism is actuated using the pressured fluid, the electric power, the data, or other signals received from the one or more couplers.

One embodiment of the present disclosure provides a method including inserting a first tubular component to the second tubular component to make a connection between the first tubular component and the second tubular component, transferring at least one of pressured fluid, data, or other signals between the first and second tubular components through the connection, and performing at least one operation of drilling, casing, and cementing through a tool coupled to the first tubular component or the second tubular component.

One embodiment of the present disclosure provides a modular connection system. The modular connection system includes a first tubular component having a first bore therethrough and one or more first load transfer features, a second tubular component having a second bore therethrough and one or more second load transfer features matching the one or more first load transfer features of the first tubular component, wherein the first tubular component is inserted to the second tubular component to make a connection to transfer bore fluid, axial loads, and torsional loads, and a locking mechanism movable to secure or disengage the connection between the first tubular component and the second tubular component.

While the foregoing is directed to embodiments of the present disclosure, other and further embodiments of the disclosure may be devised without departing from the basic scope thereof, and the scope of the invention is determined by the claims that follow.

The invention claimed is:

1. A modular connection system, comprising:

a first tubular configured to connect to a top drive, wherein the first tubular has a first bore therethrough and a load transfer feature formed on an outer surface;

a second tubular configured to connect to a tool, wherein the second tubular has a second bore and a cavity for receiving the first tubular, and the second tubular comprises:

a locking element movably disposed in the cavity between a first position and a second position, wherein when the locking element is in the first position, the first tubular is insertable into the cavity so that the first bore is connected to the second bore, and when the locking element is in the second position, the load transfer feature engages the second tubular to transfer axial loads between the first and second tubulars; and an actuator coupled to the locking element to move the locking element between the first position and the second position, wherein:

the first tubular includes a first coupler for transferring at least one of hydraulic power, electrical power, pneumatic signal, data, and electrical signal;

the second tubular includes a second coupler for transferring at least one of hydraulic power, electrical power, pneumatic signal, data, and electrical signal; and wherein when the locking element is in the first position, the first tubular is insertable into the cavity so that the first coupler is coupled to the second coupler.

2. The modular connection system of claim 1, wherein the load transfer feature of the first tubular includes two or more tapered load shoulders, wherein the two or more tapered load shoulders are spaced apart and form a bayonet profile, and the cavity of the second tubular having a bayonet profile and two or more tapered load shoulders matching the two or more load shoulders of the first tubular.

3. The modular connection system of claim 2, wherein the locking element includes two or more locking blocks, the first tubular includes two or more locking cavities, and when the first tubular is inserted into the cavity of the second tubular and the tapered shoulders of on the first tubular are engaged with the tapered shoulders on the second tubular, the locking blocks are insertable into the locking cavities to lock the engagement between the tapered load shoulders.

4. The modular connection system of claim 2, wherein the locking element comprises a guided locking plate having one or more locking blocks formed thereon, and when the first tubular is inserted into the cavity of the second tubular and the tapered shoulders on the first tubular are engaged with the tapered shoulders on the second tubular, the guided locking plate is movable to insert the one or more locking blocks between the load shoulders of the first tubular to lock the engagement between the tapered shoulders.

5. A modular connection system, comprising:

a first tubular configured to connect to a top drive, wherein the first tubular has a first bore therethrough and a load transfer feature formed on an outer surface;

a second tubular configured to connect to a tool, wherein the second tubular has a second bore and a cavity for receiving the first tubular, and the second tubular comprises:

a locking element movably disposed in the cavity between a first position and a second position, wherein when the locking element is in the first position, the first tubular is insertable into the cavity so that the first bore is connected to the second bore, and when the locking element is in the second position, the load transfer feature engages the second tubular to transfer axial loads between the first and second tubulars; and wherein the load transfer feature of the first tubular includes two or more tapered load shoulders, wherein the two or more tapered load shoulders are spaced apart and form a bayonet profile, and the cavity of the second tubular having a bayonet profile and two or more tapered load shoulders matching the two or more load shoulders of the first tubular.

6. The modular connection system of claim 5, wherein the locking element includes two or more locking blocks, the first tubular includes two or more locking cavities, and when the first tubular is inserted into the cavity of the second tubular and the tapered shoulders of on the first tubular are engaged with the tapered shoulders on the second tubular, the locking blocks are insertable into the locking cavities to lock the engagement between the tapered load shoulders.

7. The modular connection system of claim 5, wherein the locking element comprises a guided locking plate having one or more locking blocks formed thereon, and when the first tubular is inserted into the cavity of the second tubular and the tapered shoulders on the first tubular are engaged with the tapered shoulders on the second tubular, the guided locking plate is movable to insert the one or more locking blocks between the load shoulders of the first tubular to lock the engagement between the tapered shoulders.

* * * * *